US011384765B2

(12) United States Patent
Nakai

(10) Patent No.: US 11,384,765 B2
(45) Date of Patent: Jul. 12, 2022

(54) AIR CONDITIONER

(71) Applicant: DAIKIN INDUSTRIES, LTD., Osaka (JP)

(72) Inventor: Satoshi Nakai, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 40 days.

(21) Appl. No.: 16/649,951

(22) PCT Filed: Sep. 27, 2018

(86) PCT No.: PCT/JP2018/035991
§ 371 (c)(1),
(2) Date: Mar. 23, 2020

(87) PCT Pub. No.: WO2019/065857
PCT Pub. Date: Apr. 4, 2019

(65) Prior Publication Data

US 2020/0277960 A1 Sep. 3, 2020

(30) Foreign Application Priority Data

Sep. 27, 2017 (JP) ..... JP2017-186489

(51) Int. Cl.
*F04D 17/04* (2006.01)
*F24F 1/0025* (2019.01)
(Continued)

(52) U.S. Cl.
CPC ..... *F04D 17/04* (2013.01); *F24F 1/0025* (2013.01); *F04D 29/283* (2013.01);
(Continued)

(58) Field of Classification Search
CPC ..... F04D 17/04; F04D 29/281; F04D 29/666; F24F 1/0025; F24F 13/24
See application file for complete search history.

(56) References Cited

U.S. PATENT DOCUMENTS 5,573,059 A * 11/1996 Hamamoto ..... F24F 1/0057 165/124
6,158,954 A * 12/2000 Nabeshima ..... F04D 29/283 415/119
(Continued)

FOREIGN PATENT DOCUMENTS

EP 2 476 908 A1 7/2012
JP 58-219337 A 12/1983
(Continued)

OTHER PUBLICATIONS

International Search Report of corresponding PCT Application No. PCT/JP2018/035991 dated Nov. 13, 2018.
(Continued)

*Primary Examiner* — Brian P Wolcott
*Assistant Examiner* — Jackson N Gillenwaters
(74) *Attorney, Agent, or Firm* — Global IP Counselors, LLP

(57) ABSTRACT

An air conditioner includes a cross-flow fan having a cylindrical shape, and a heat exchanger disposed on an upstream side of an air flow of the cross-flow fan. The cross-flow fan includes a plurality of impellers. Each of the impellers includes a plurality of blades arranged in a circumferential direction. A clearance is formed between the cross-flow fan and the heat exchanger. The clearance has a dimension no more than 20% of a diameter of each of the impeller. The impellers are arranged with at least one of the blades displaced between each adjacent two of the impellers. A number of the impellers arranged along a rotation axis is at least 14 and no more than 30 in the cross-flow fan.

13 Claims, 35 Drawing Sheets

(51) Int. Cl.

| | |
|---|---|
| ***F04D 29/28*** | (2006.01) |
| ***F04D 29/66*** | (2006.01) |
| ***F24F 13/24*** | (2006.01) |
| *F24F 1/0011* | (2019.01) |

(52) U.S. Cl.
CPC ..... *F04D 29/666* (2013.01); *F24F 1/0011* (2013.01); *F24F 2013/247* (2013.01)

(56) References Cited

U.S. PATENT DOCUMENTS

| | | | | |
|---|---|---|---|---|
| 6,511,291 | B2 * | 1/2003 | Koochingchai | F04D 29/0563 415/60 |
| 8,814,522 | B2 * | 8/2014 | Amada | F04D 29/666 416/200 R |
| 9,127,681 | B2 | 9/2015 | Ohtsuka et al. | |
| 9,347,461 | B2 * | 5/2016 | Shiraichi | F04D 17/04 |
| 10,156,376 | B2 * | 12/2018 | Nakai | F04D 17/04 |
| 11,073,302 | B2 * | 7/2021 | Teraoka | F04D 29/66 |
| 2002/0094005 | A1 | 7/2002 | Partlo et al. | |
| 2003/0194311 | A1 | 10/2003 | Ahn et al. | |
| 2008/0310960 | A1 | 12/2008 | Amada et al. | |
| 2011/0171004 | A1 * | 7/2011 | Shiraichi | F04D 17/04 415/53.1 |

FOREIGN PATENT DOCUMENTS

| | | | |
|---|---|---|---|
| JP | 2-106632 | A | 4/1990 |
| JP | 6-173886 | A | 6/1994 |
| JP | 7-30926 | A | 4/1995 |
| JP | 8-200283 | A | 8/1996 |
| JP | 2000-73991 | A | 3/2000 |
| JP | 2000-120578 | A | 4/2000 |
| JP | 3107711 | B2 | 9/2000 |
| JP | 3460350 | B2 | 8/2003 |
| JP | 2003-269363 | A | 9/2003 |
| JP | 2004-3467 | A | 1/2004 |
| JP | 2005-501400 | A | 1/2005 |
| JP | 2005-76952 | A | 3/2005 |
| JP | 2006-275488 | A | 10/2006 |
| JP | 2006275488 | A * | 10/2006 |
| JP | 2014-66256 | A | 4/2014 |
| KR | 10-2006-0089076 | A | 8/2006 |
| WO | 2004/029463 | A1 | 4/2004 |

OTHER PUBLICATIONS

International Preliminary Report of corresponding PCT Application No. PCT/JP2018/035991 dated Apr. 9, 2020.
European Search Report of corresponding EP Application No. 18 86 0476.3 dated Oct. 1, 2020.
The Japan Society of Mechanical Engineers (Nihon Kikai Gakkai), "Handbook for Machine Noise", pp. 1-9, Oct. 1991, Japan.

* cited by examiner

AIR CONDITIONER

CROSS-REFERENCE TO RELATED APPLICATIONS

This U.S. National stage application claims priority under 35 U.S.C. § 119(a) to Japanese Patent Application No. 2017-186489, filed in Japan on Sep. 27, 2017, the entire contents of which are hereby incorporated herein by reference.

BACKGROUND

Field of the Invention

The present disclosure relates to an air conditioner, and particularly, to an air conditioner provided with a cross-flow fan.

Background Information

It has been conventionally known that a cross-flow fan produces a noise having a frequency of the product of the number N of revolutions per second and the number Z of blades arranged on the circumference of a circle (N×Z) (hereinbelow, referred to as an NZ sound) as described in, for example, JP 3460350 B2. Hereinbelow, a value of N×Z is referred to as NZ. Further, it is also desired to reduce a noise having frequencies of multiples of NZ, specifically, the noise of 2NZ to 3NZ sounds as much as possible among noises produced by the cross-flow fan. Further, there is known a phenomenon in which the NZ sound and the 2NZ sound are increased by a reduction in the distance between the cross-flow fan and a heat exchanger.

SUMMARY

In view of the above, in the cross-flow fan described in JP 3460350 B2, for example, 10 impellers having the same shape are arranged in the rotation axis direction, and adjacent impellers are displaced in the circumferential direction to provide a phase difference (skew angle) between the impellers. In the cross-flow fan of JP 3460350 B2, one phase difference is made different from another phase difference to reduce the NZ sound and the like.

However, even in the invention of the cross-flow fan described in JP 3460350 B2, an effect of reducing the 2NZ sound and the 3NZ sound is not sufficiently obtained.

It is an object of the present invention to provide a highly quiet air conditioner in which the noise of 2NZ to 3NZ sounds is reduced.

An air conditioner according to a first aspect of the present disclosure is an air conditioner including: a cross-flow fan having a cylindrical shape, the cross-flow fan including a plurality of impellers, each of the impellers including a plurality of blades arranged in a circumferential direction: and a heat exchanger disposed on an upstream side of an air flow of the cross-flow fan with a clearance between the cross-flow fan and the heat exchanger, the clearance having a dimension of equal to or less than 20% of a diameter of each of the impellers, in which the impellers are arranged with at least one of the blades displaced between each adjacent two of the impellers, and the number of impellers arranged along a rotation axis is 14 or more and 30 or less in the cross-flow fan.

According to the air conditioner of the first aspect, the noises of 2NZ to 3NZ sounds produced in the respective impellers can be sufficiently cancelled with each other.

An air conditioner according to a second aspect of the present disclosure is the air conditioner according to the first aspect in which the cross-flow fan includes 17 or more and 25 or less impellers.

According to the air conditioner of the second aspect, since the number of impellers is 17 or more, a variation range in the noise including 2NZ to 3NZ sounds due to fluctuations caused by the tolerance of the phase shift (skew angle) is reduced. Further, since the number of impellers is 25 or less, it is possible to prevent an air blowing resistance by partition plates from becoming too large.

An air conditioner according to a third aspect of the present disclosure is the air conditioner according to the first or second aspect in which a length dimension of each of the impellers in a rotation axis direction is equal to or less than 40% of the diameter of each of the impellers in the cross-flow fan.

According to the air conditioner of the third aspect, the length of the cross-flow fan can also be reduced, and the length of the air conditioner in the rotation axis direction can be reduced.

An air conditioner according to a fourth aspect of the present disclosure is the air conditioner according to any one of the first to third aspects in which the heat exchanger is disposed with the clearance equal to or less than 10% of the diameter.

According to the air conditioner of the fourth aspect, a space occupied by the heat exchanger and the cross-flow fan can be reduced.

An air conditioner according to a fifth aspect of the present disclosure is the air conditioner according to any one of the first to fourth aspects in which the diameter is 90 mm or more and 150 mm or less, and the number of revolutions is 700 rpm or more and 2000 rpm or less in the cross-flow fan.

According to the air conditioner of the fifth aspect, a sufficient air blowing amount can be obtained by the impellers.

In the air conditioner according to the first aspect of the present disclosure, it is possible to reduce the noise of 2NZ to 3NZ sounds.

In the air conditioner according to the second aspect of the present disclosure, it is possible to stably supply the air conditioner having an excellent air blowing performance and high quietness.

In the air conditioner according to the third or fourth aspect of the present disclosure, it is possible to make the air conditioner compact.

In the air conditioner according to the fifth aspect of the present disclosure, it is possible to obtain a sufficient air blowing performance.

DETAILED DESCRIPTION OF EMBODIMENT(S)

(1) Entire Configuration

Figure 1:
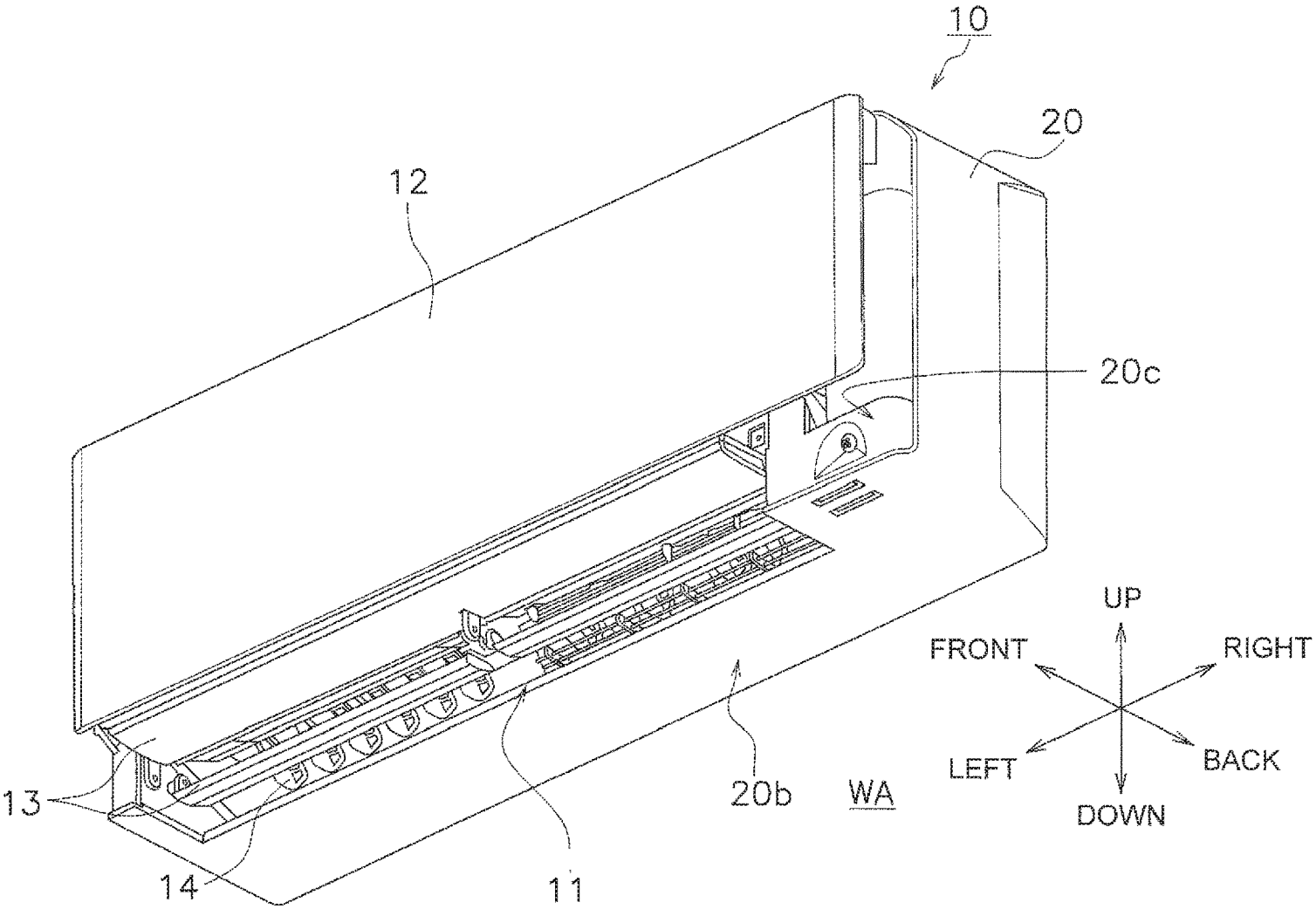
FIG. 1 is a perspective view of the appearance of an air conditioner according to an embodiment of the present disclosure.

FIG. 1 illustrates the appearance of an air conditioner 10 according to an embodiment, the air conditioner 10 being mounted on a wall WA. Hereinbelow, positional relationships between elements of the air conditioner 10 will be described using front and back, right and left, and up and down directions indicated by arrows in FIG. 1. The shape of the air conditioner 10 is substantially set based on a rectangular parallelepiped elongated in the right-left direction. Thus, a casing 20 also has a shape elongated in the right-left direction. The air conditioner 10 includes a blow-out port 11, which extends long in the right-left direction from a bottom face 20*b* through a front face 20*c* of the casing 20.

When the air conditioner 10 is in a stopped state, the blow-out port 11 is closed with one of two horizontal flaps 13 and a front panel 12. When the air conditioner 10 performs a heating operation or a cooling operation, the one horizontal flap 13 and the front panel 12 move to bring the air conditioner 10 into a state in which the blow-out port 11 is open as illustrated in FIG. 1.

Figure 2:
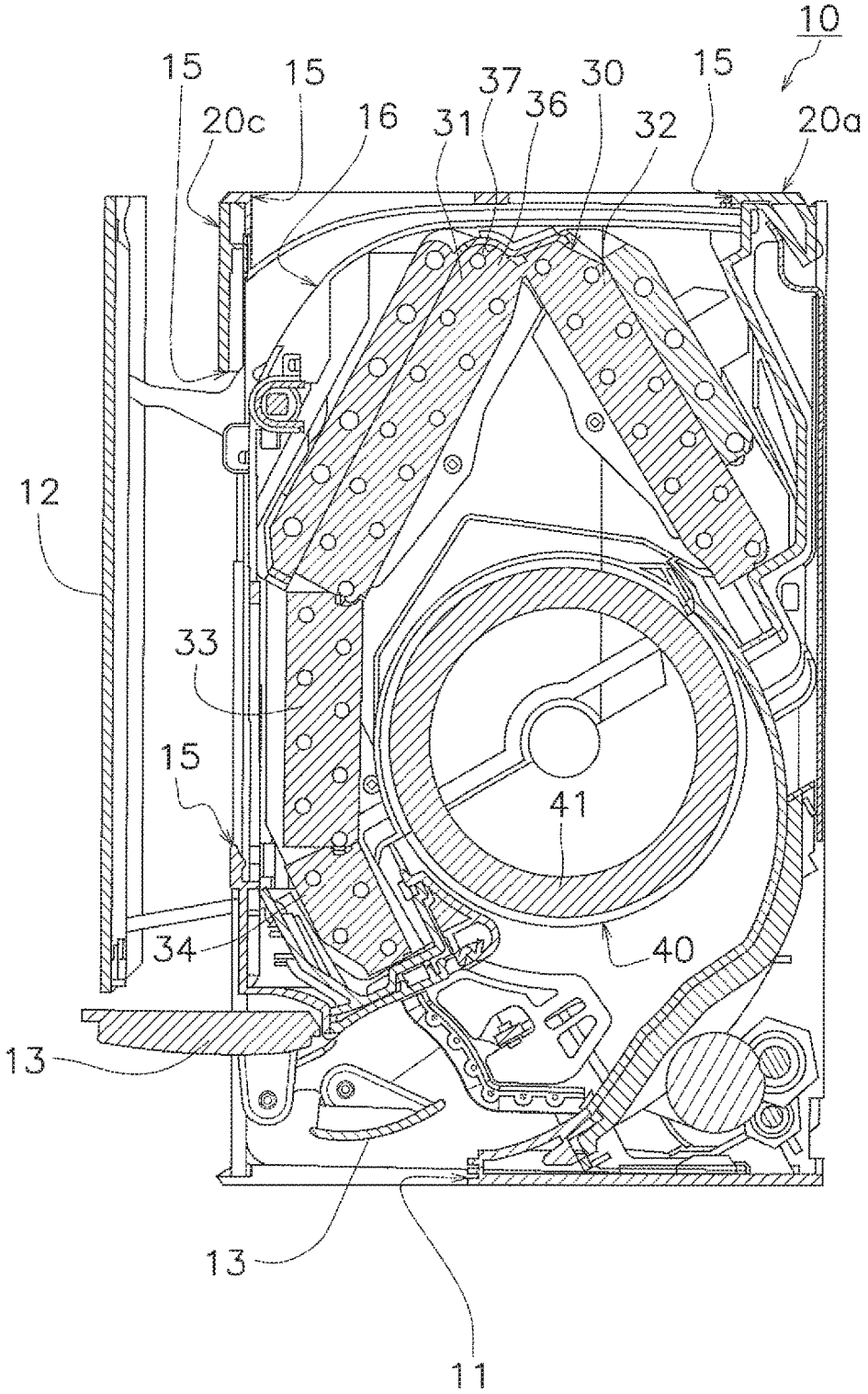
FIG. 2 is a sectional view of the air conditioner of FIG. 1.

FIG. 2 illustrates a sectional structure of the air conditioner 10 cut on a plane perpendicular to the right-left direction at a part including the blow-out port 11. FIG. 2 illustrates a state in which the blow-out port 11 is open similarly to FIG. 1. In the air conditioner 10 with the blow-out port 11 open, an intake port 15 is open not only on a top face 20*a*, but also on the front face 20*c*.

An air filter 16 is disposed downstream of the intake port 15. Substantially all indoor air drawn in through the intake port 15 passes through the air filter 16. The air filter 16 removes dust from indoor air. A heat exchanger 30 is disposed downstream of the air filter 16.

The heat exchanger 30 is a fin and tube type heat exchanger which includes a heat transfer fin 36, which made of a thin metal plate, and a heat transfer tube 37, which made of a metal tube. The heat exchanger 30 includes a plurality of heat transfer fins 36, which are arranged in the right-left direction of the air conditioner 10. A plurality of heat transfer tubes 37, which extend in the right-left direction, penetrate the heat transfer fins 36, which are included in a plane extending in the up-down and front-back directions. The heat transfer tubes 37 are connected to a refrigerant inlet and a refrigerant outlet of the heat exchanger 30, and a refrigerant flows inside the heat transfer tubes 37. In the heat exchanger 30, heat is exchanged between the refrigerant flowing inside the heat transfer tubes 37 and indoor air passing between the heat transfer fins 36. The heat exchanger 30 can be divided into a first heat exchange section 31, which is located on the front side of a part bent in a A-shape, a second heat exchange section 32, which is located on the back side of the A-shaped part, a third heat exchange section 33, which is disposed under the first heat exchange section 31, and a fourth heat exchange section 34, which is disposed under the third heat exchange section 33. The length of the first heat exchange section 31, the second heat exchange section 32, the third heat exchange section, and the fourth heat exchange section 34 in the right-left direction substantially corresponds to the length of the blow-out port 11 in the right-left direction. The distance between the front panel 12 and the third heat exchange section 33 during operation is, for example, approximately 30 mm to 60 mm.

Figure 3:
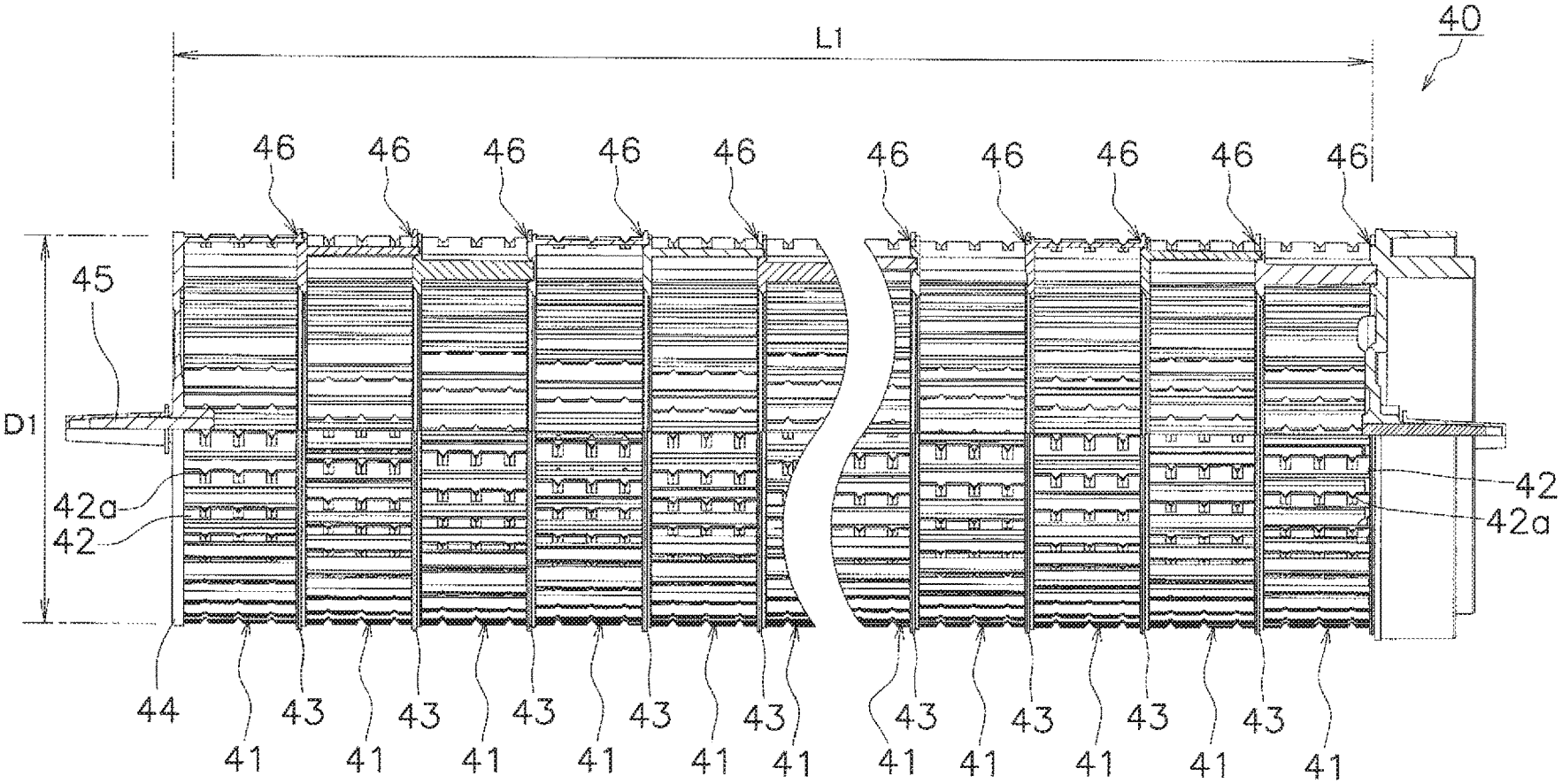
FIG. 3 is a partially cutaway plan view of impellers of a cross-flow fan.

A plurality of impellers 41 of a cross-flow fan 40 are disposed downstream of the heat exchanger 30. The cross-flow fan 40 is provided with a motor (not illustrated) which drives the impellers 41. In the air conditioner 10, 20 impellers 41 are coupled together in the right-left direction. FIG. 3 illustrates the entire configuration of the 20 impellers 41. In FIG. 3, the impellers 41 are cut away approximately in half on a rotation axis, and cross-sections of the impellers 41 are also illustrated. A total length L1 of the 20 impellers 41 substantially corresponds to the length of the blow-out port 11 in the right-left direction. The total length L1 of the impellers 41 is, for example, approximately 500 mm to 1000 mm. The 20 impellers 41 are integrated together by joining boundary parts 46 between blades 42 of the impellers 41 adjacent to each other and partition plates 43 by ultrasonic welding.

Figure 4:
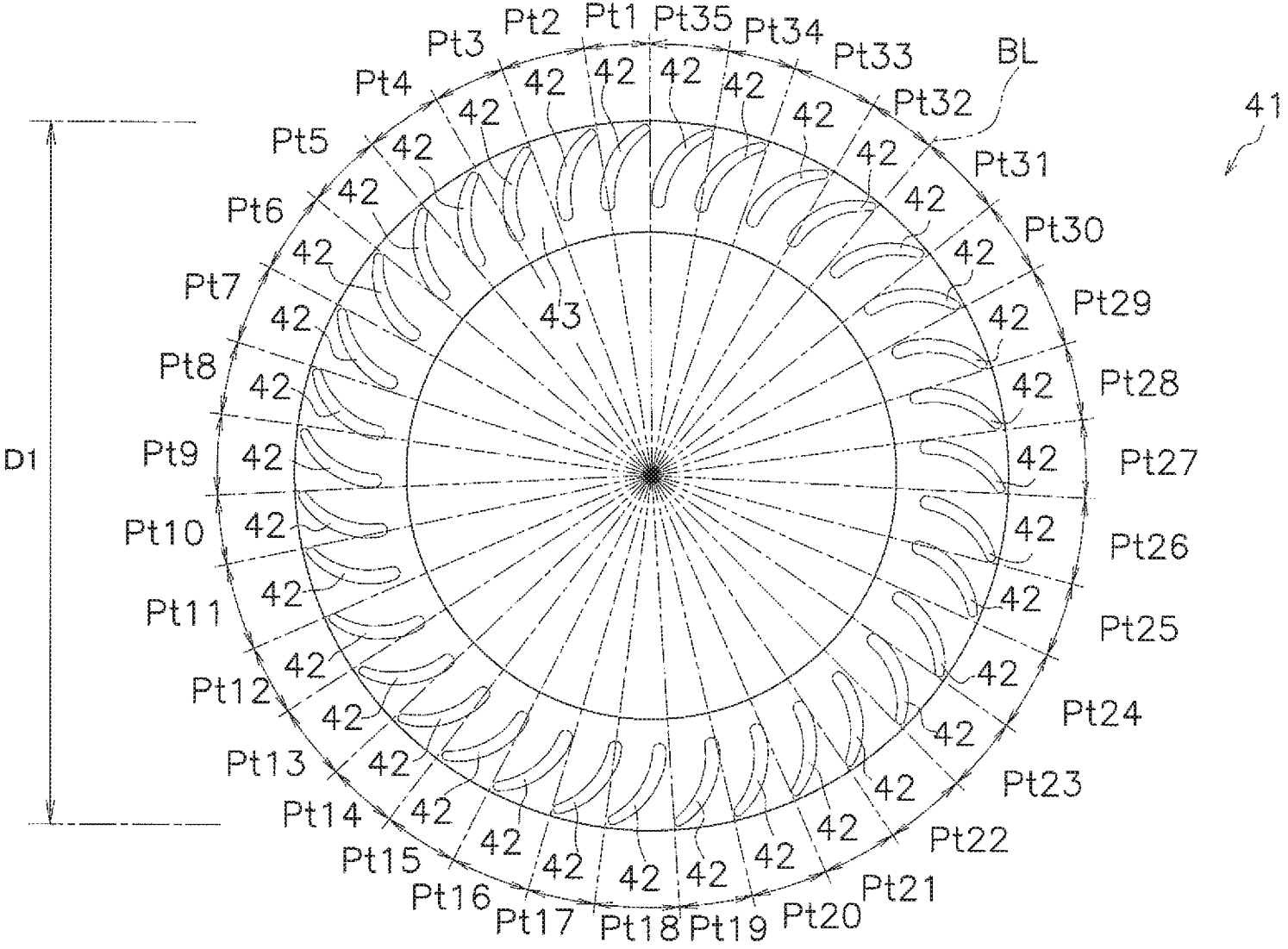
FIG. 4 is a schematic view of one of the impellers viewed in a rotation axis direction.

As illustrated in FIG. 4, each of the impellers 41 includes 35 blades 42, which are arranged on the circumference of a circle. In FIG. 4, dot-dash lines which radially extend from the center of the partition plate 43 indicate reference lines BL for determining pitch angles Pt1 to Pt35. The reference line BL is a tangent which passes through a center point (rotation axis) of the outer periphery of the partition plate 43 and is in contact with the outer peripheral side of each of the blades 42 when viewed in the rotation axis direction. Not all the pitch angles Pt1 to Pt35 between adjacent blades 42 are equal to each other, but some of them are different from each other. For example, the pitch angle Pt35 is larger than the pitch angle Pt1. In the following description, an impeller in which all the pitch angles Pt1 to Pt35 are equal to each other is referred to as an equal-pitch impeller, and an impeller having unequal pitches (having different pitches in some parts) is referred to as an unequal-pitch impeller. These 35 blades 42 are fixed to the partition plate 43. However, the blades 42 of the impeller 41 on one end are fixed to an end plate 44. A shaft 45, which extends along the rotation axis, is attached to the end plate 44. The length of each of the impellers 41 is preferably equal to or less than 50 mm, and more preferably equal to or less than 30 mm because 20 impellers 41 can be coupled together with the total length L1 of 600 mm.

In the present embodiment, the diameter of the largest one of circles having centers on the rotation axis and passing through the outer peripheral ends of the blades 42 is defined as a diameter D1 (refer to FIG. 4) of the cross-flow fan 40. The blade 42 includes three cutouts 42*a* formed on the outer peripheral end side. The diameter of a circle passing through a part closest to the rotation axis in the cutouts 42*a* is smallest. That is, the diameter D of the cross-flow fan 40 is the diameter of a circle passing through a part where the cutouts 42*a* are not formed on the outer peripheral end side of each blade 42. The cross-flow fan 40 is capable of obtaining a sufficient air blowing performance, for example, at the number of revolutions of 700 rpm or more and 2000 rpm or less in the case where the diameter D1 of the impeller 41 is 90 mm or more and 150 mm or less.

The blades 42, which are fixed to the partition plate 43 or the end plate 44, extend along the rotation axis. Each of the impellers 41 is formed, for example, by injection molding, and the 35 blades 42 and the partition plate 43 or the end plate 44 are integrally molded. These 20 impellers 41 are disposed at equal pitch angles Pt1 to Pt35. That is, when viewed in the rotation axis direction, the positions of 35 blades 42 of impellers 41 adjacent to each other can be aligned.

Figure 5:
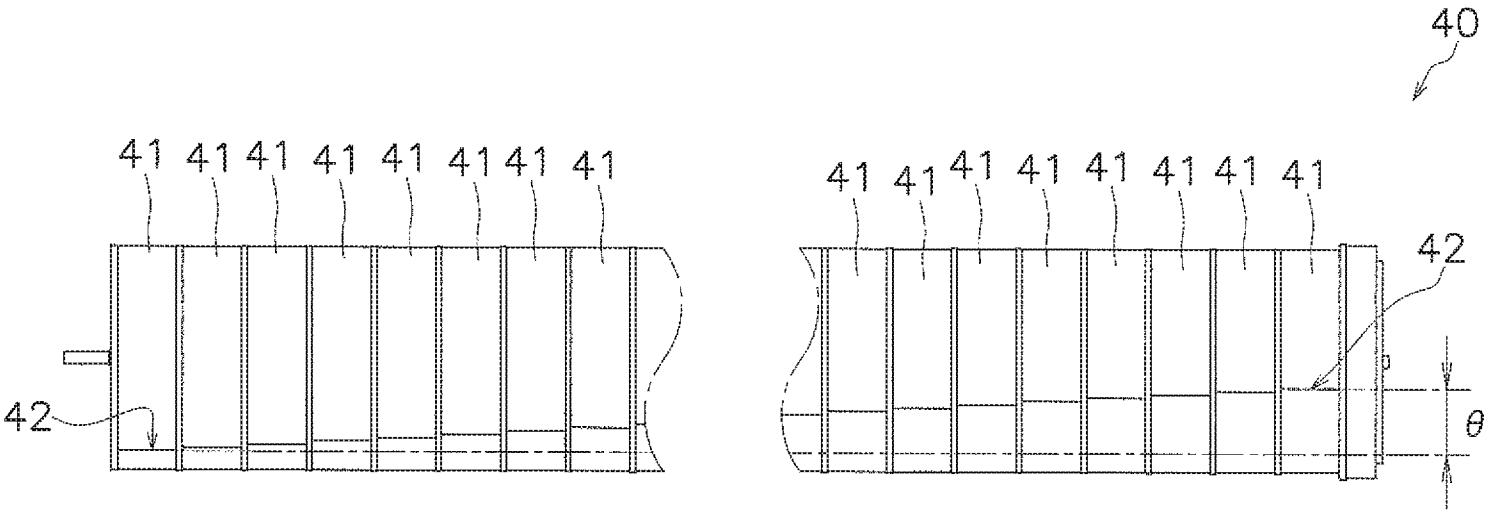
FIG. 5 is a schematic view for describing a skew angle for a plurality of impellers.

However, as illustrated in FIG. 5, a skew angle θ is set on the cross-flow fan 40. The skew angle θ is an angle by which the blades 42 are displaced between adjacent impellers 41. In this case, between adjacent impellers 41, the 35 blades 42 of one impeller 41 are displaced by θ from the respective 35 blades 42 of the other impeller 41.

Figure 6:
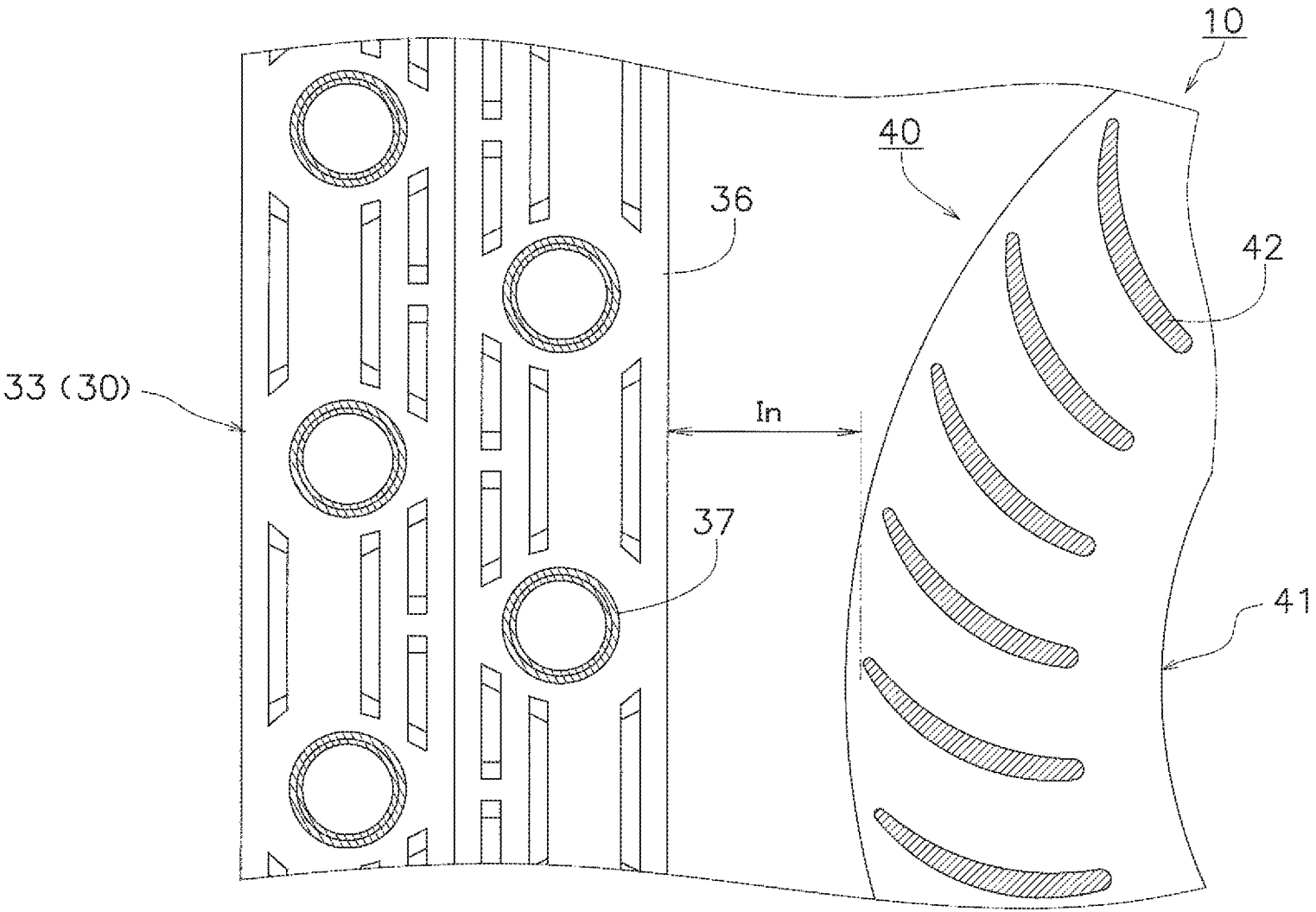
FIG. 6 is a partially enlarged sectional view of a part around the impeller for describing a clearance between the impeller and a heat exchanger.

A place where the impeller 41 and the heat exchanger 30 are close to each other is one of places where noise tends to occur in the impeller 41. FIG. 6 illustrates a part where the heat exchanger 30 and the impeller 41 are closest to each other in an enlarged manner. As a clearance In illustrated in FIG. 6 becomes smaller, noise tends to increase. The clearance In is the distance from the circle having the diameter D1 of the cross-flow fan 40 to the heat transfer fin 36 of the heat exchanger 30. The clearance In may be increased in order to reduce noise. However, when the clearance In is increased, a depth dp of the air conditioner 10 in the front-back direction disadvantageously increases. The depth dp of the air conditioner 10 is, for example, 150 mm to 200 mm, which is the sum of the diameter D1 and the thickness of the heat exchanger 30.

Figure 7:
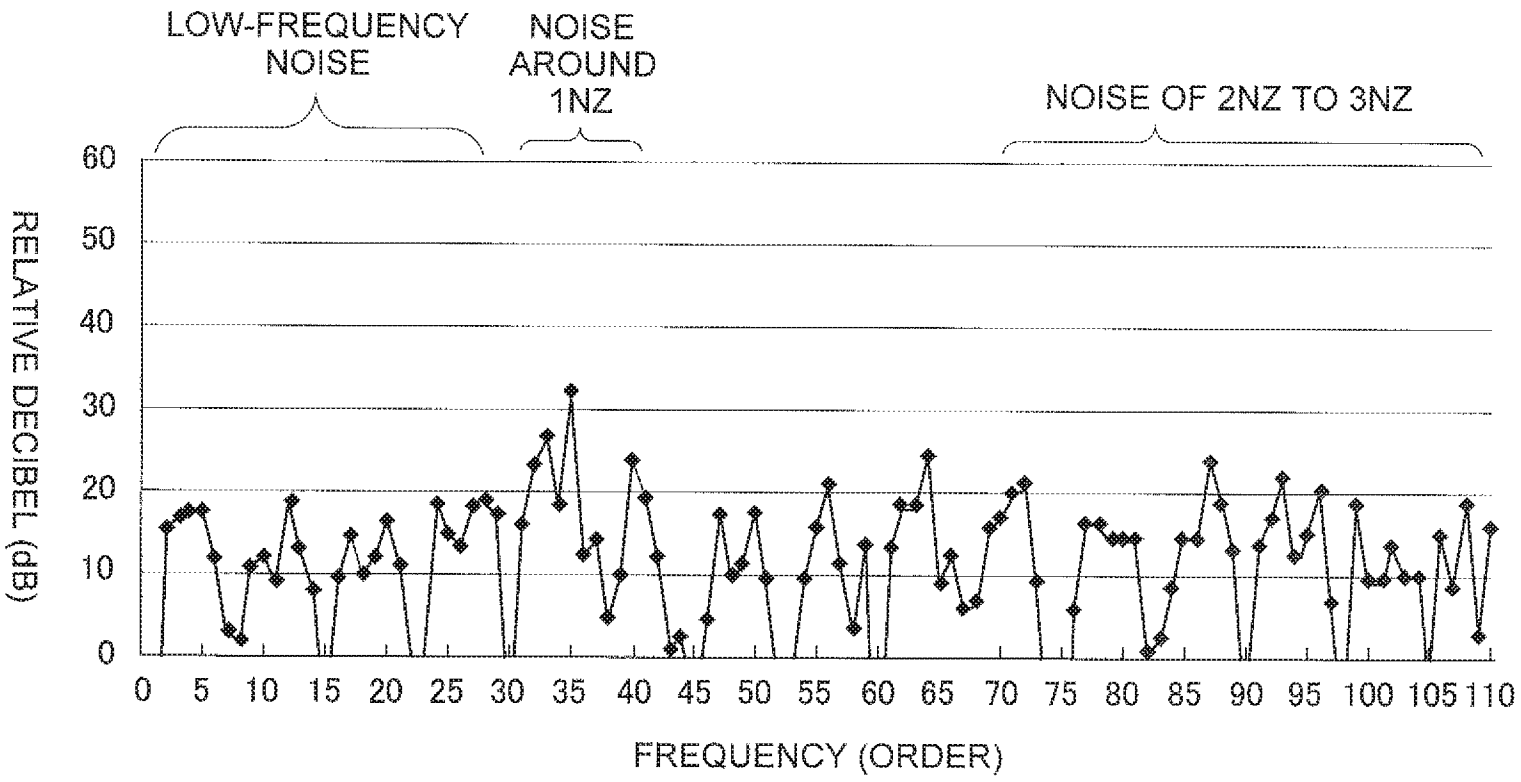
FIG. 7 is a graph showing an example of the relationship between a frequency and a relative decibel in a case where the skew angle is 2.4°.
Figure 8:
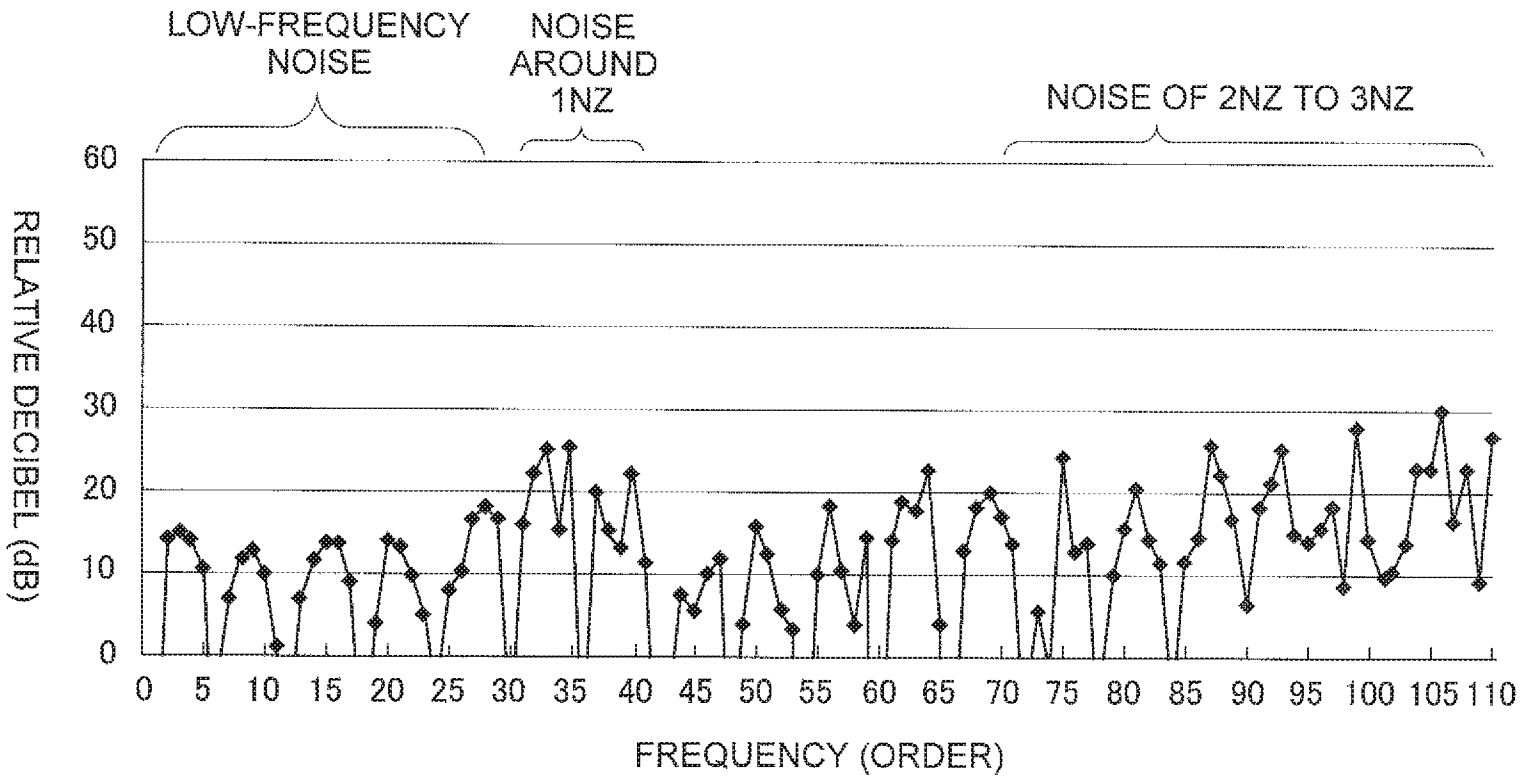
FIG. 8 is a graph showing an example of the relationship between a frequency and a relative decibel in a case where the skew angle is 3.0°.
Figure 9:
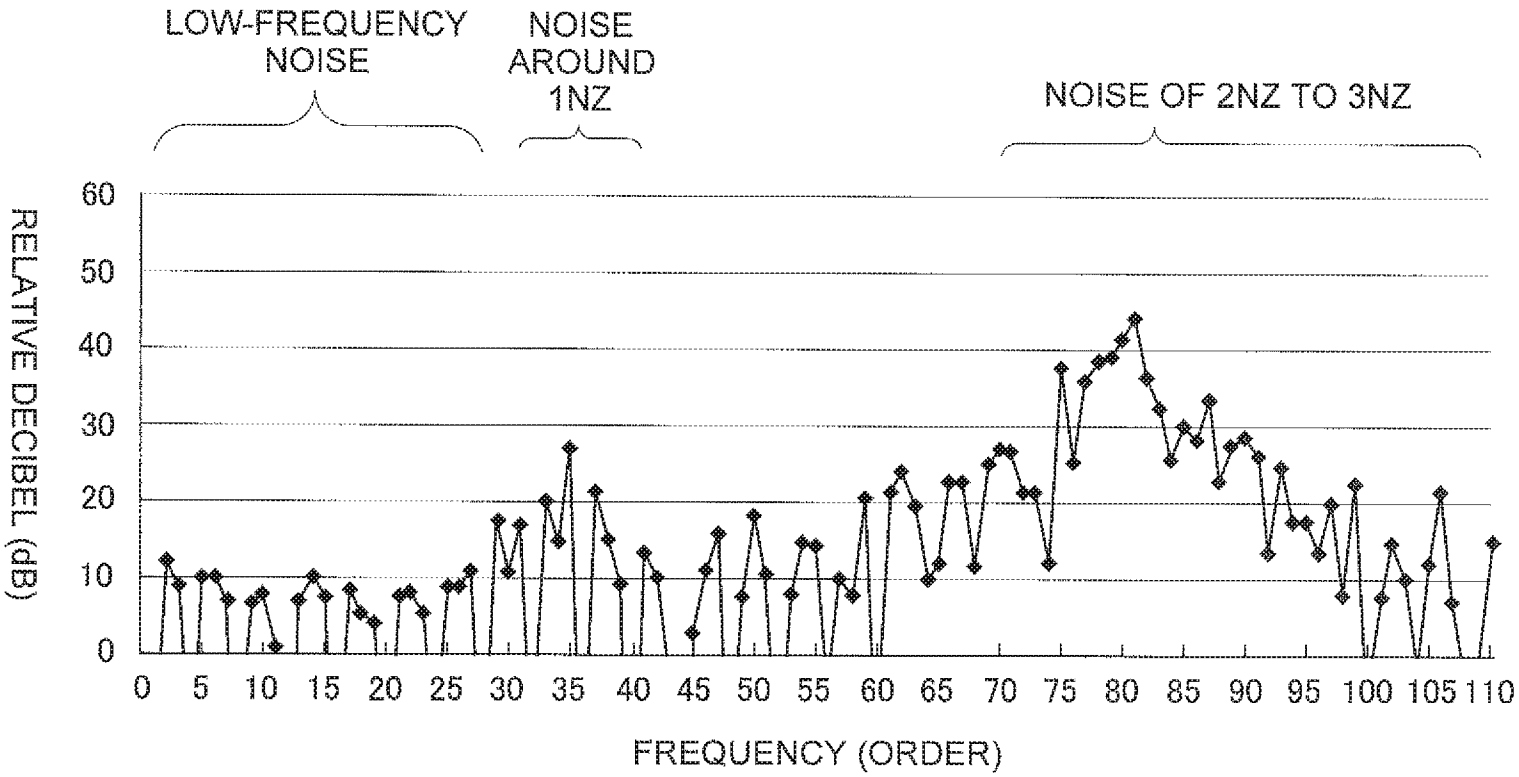
FIG. 9 is a graph showing an example of the relationship between a frequency and a relative decibel in a case where the skew angle is 4.5°.
Figure 10:
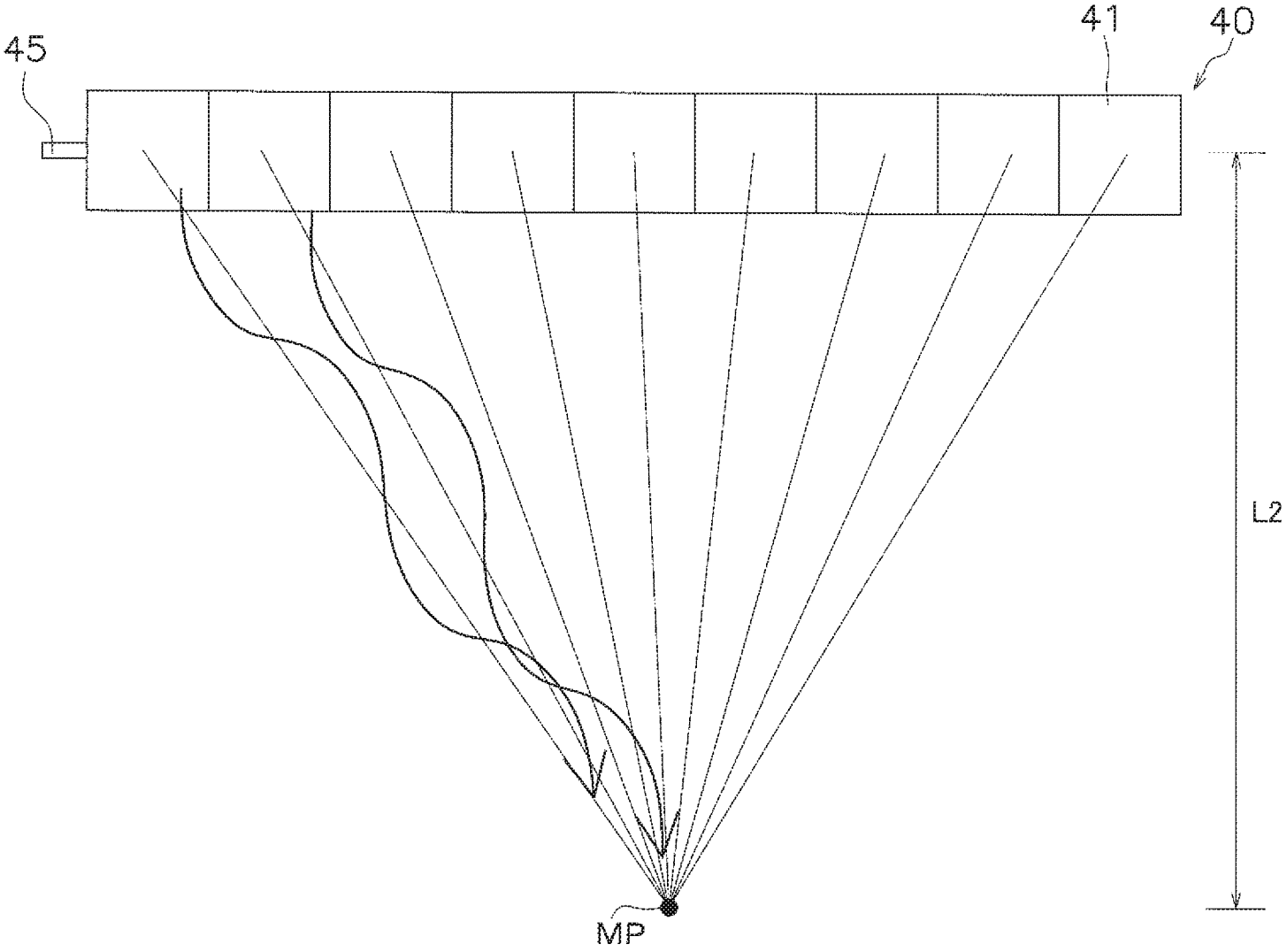
FIG. 10 is a schematic diagram for describing a simulation method when sound pressure levels are compared.

(2) Detailed Configuration (2-1) Relationship Between Skew Angle and Noise of Impeller FIGS. 7, 8, and 9 show the relationship between a frequency and a relative decibel with different skew angles (in the cases where the skew angle is 2.4°, 3.0°, and 4.5°) for the cross-flow fan 40 including 20 impellers 41. Graphs in FIGS. 7, 8, and 9 are based on simulations. As shown in FIG. 10, the simulations are performed in such a manner that, point sound sources are assumed to be on the centers of the respective impellers 41, sounds produced on these point sound sources are synthesized at a measurement point MP to obtain noise, and a Fourier analysis of the obtained noise is performed to calculate the relative decibel of a frequency of each order. A phase difference corresponding to the skew angle is given to the sound produced from the point sound source of each of the impellers 41. Further, the measurement point MP is a point which is located on perpendicular lines passing through the centers of all the impellers 41 in the rotation axis direction and separated from the impellers 41 by a predetermined distance L2. These simulations are performed for checking a tendency of a sound pressure level for each frequency, and it is only required that sound pressure levels can be compared. Thus, in the graphs of FIGS. 7, 8, and 9, the vertical axis represents a relative sound pressure level (relative decibel). The relative decibel is represented relative to 60 dB which is defined as a sound pressure level in a case where 10 equal-pitch impellers with no cutout are coupled together with a skew angle of 0°. For example, a relative decibel of 20 dB means that the sound pressure level is reduced by 40 dB.

In FIGS. 7, 8, and 9, the frequency is represented in rotation order. A frequency represented as the first rotation order corresponds to the number of revolutions of the cross-flow fan 40, and, for example, 15 Hz (=900 rpm/60 sec) when the number of revolutions of the cross-flow fan 40 is 900 rpm. Thus, in the above case, a frequency represented as the second rotation order is 30 Hz (=15×2). Further, since each of the impellers 41 includes the 35 blades 42, a frequency of 35th corresponds to 1NZ. For example, in the above case, 1NZ corresponds to 525 Hz (=35×900/60).

Each of the impellers 41 is an unequal-pitch impeller. Thus, there is a tendency that, not only a sound having a frequency of 1NZ (the frequency of 35th) becomes larger, but also sounds having frequencies around 1NZ (e.g., frequencies of 33th, 34th, 36th, and 37th) become lager. Thus, in order to analyze noise of the unequal-pitch impeller 41, it is more appropriate to observe sounds having frequencies in a predetermined range around 1NZ including frequencies close to the frequency of 1NZ. In the graphs in FIGS. 7 to 9, a noise having frequencies in a range of 32th to 40th is defined as a noise around 1NZ.

Further, in FIGS. 7 to 9, a sound having a lower frequency than the noise around 1NZ is referred to as a low-frequency noise. In the graphs in FIGS. 7 to 9, the low-frequency noise is a noise including sounds having frequencies equal to or lower than 28th. Further, a noise of 2NZ to 3NZ is a noise including sounds having frequencies from 70th to 110th.

Figure 11:
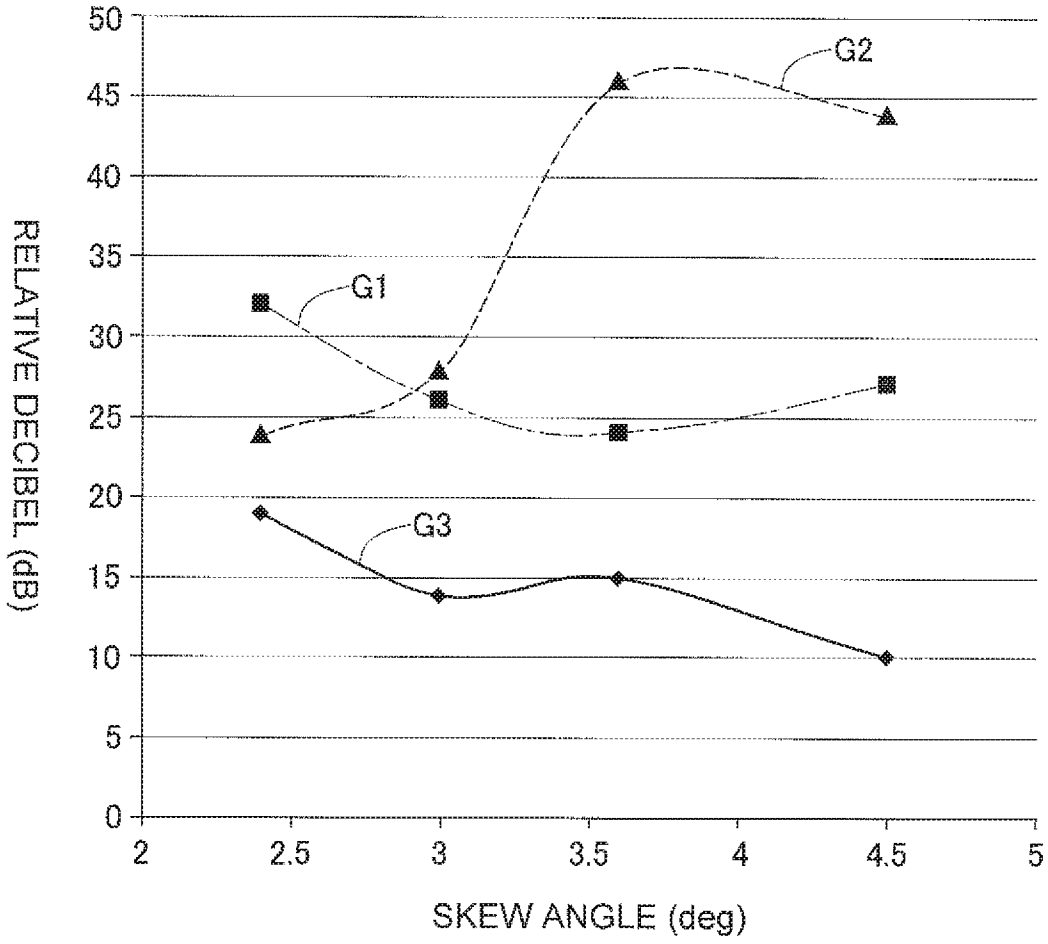
FIG. 11 is a graph showing an example of the relationship between the relative decibel of a noise around 1NZ, a noise of 2NZ to 3NZ, and a low-frequency noise and the skew angle.

FIG. 11 shows an example of the relationship between the relative decibel and the skew angle using a graph G1 of the noise around 1NZ, a graph G2 of the noise of 2NZ to 3NZ, and a graph G3 of the low-frequency noise in a case where 20 impellers 41 are coupled together. The graphs in FIG. 11 are created based on the graphs in FIGS. 7 to 9. The graph G2 of FIG. 11 shows that the noise of 2NZ to 3NZ can be reduced by making the skew angle smaller. In particular, when the skew angle is 3.0° and 2.4°, the noise of 2NZ to 3NZ is reduced. On the other hand, the graph G3 of FIG. 11 shows that it is preferred to make the skew angle larger in order to improve the low-frequency noise reduction. That is, FIG. 11 shows a trade-off relationship such that the low-frequency noise is increased by making the skew angle smaller in order to improve the noise of 2NZ to 3NZ reduction, and the noise of 2NZ to 3NZ is increased by making the skew angle larger in order to reduce the low-frequency noise.

Figure 12:
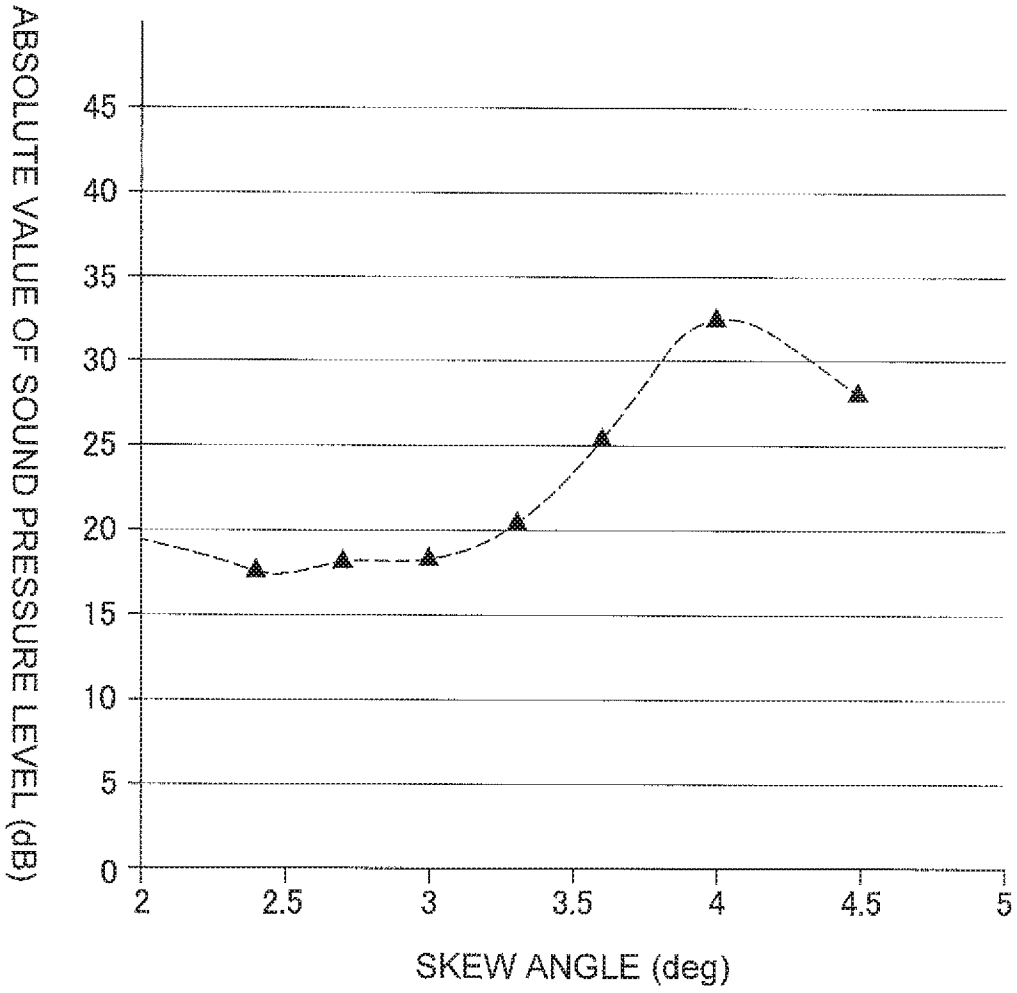
FIG. 12 is a graph showing an example of the relationship between the skew angle and a sound pressure level of 2.5NZ.
Figure 13:
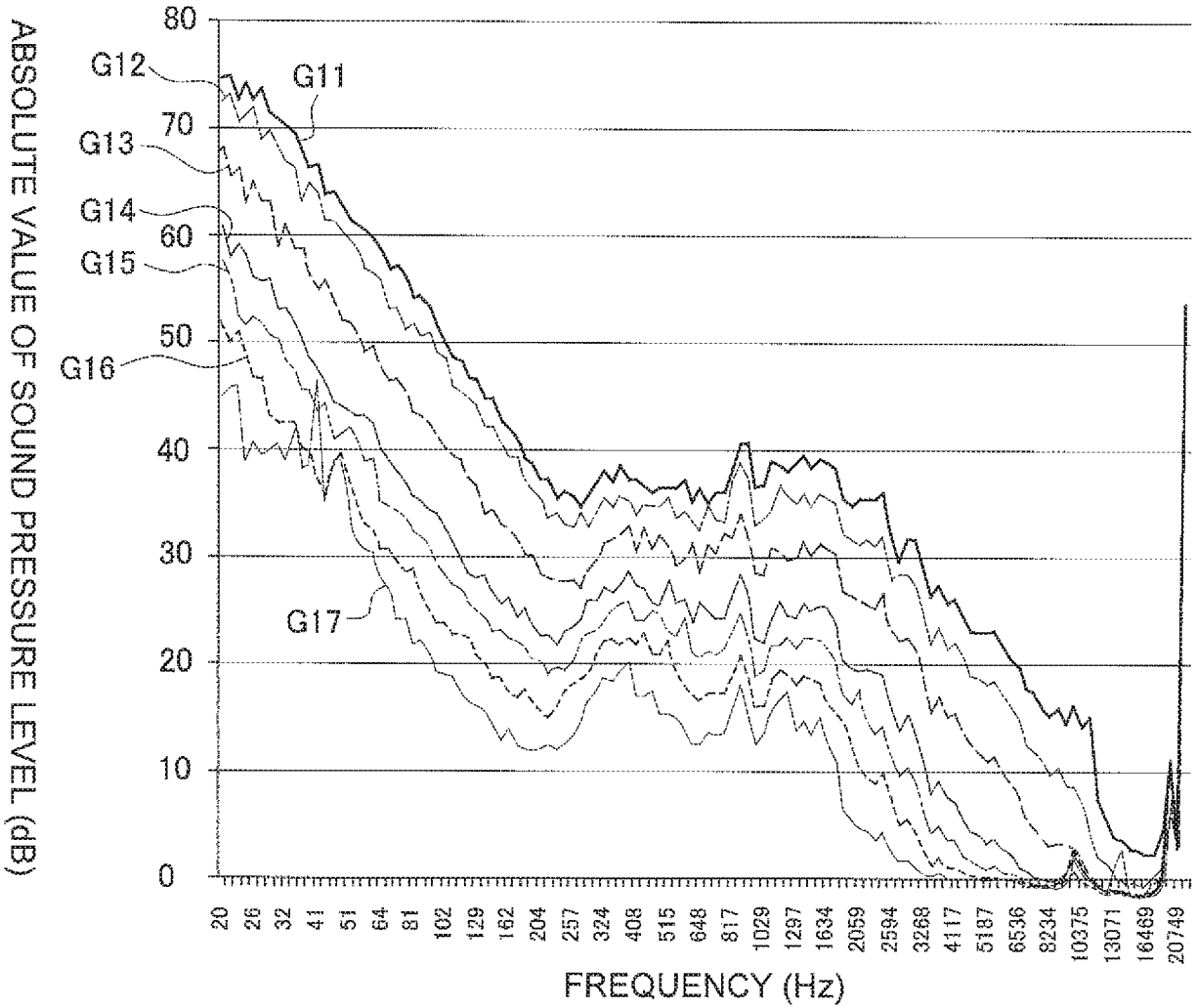
FIG. 13 is a graph showing an example of the relationship between the frequency and the sound pressure level in noise produced by 20 impellers which are coupled together with a skew angle of 3.0°.

FIG. 12 shows an example of an actual measured value of a 2.5NZ sound obtained by changing the skew angle in a case where the number of revolutions of the cross-flow fan 40 including 20 impellers 41 is 900 rpm. The graph G2 of FIG. 11 and the graph of FIG. 12 have the same tendency that a change is small when the skew angle is from 2.5° to 3.0°, and the inclination of the graph increases from a skew angle between 3.0° and 3.5°. Graphs G11, G12, G13, G14, G15, G16, and G17 of FIG. 13 show the relationship between a frequency and an absolute value of a sound pressure level actually measured by using the cross-flow fan 40 including 20 impellers 41 and having a screw angle of 3.0° and changing the number of revolutions of the cross-flow fan 40 to 1650 rpm, 1500 rpm, 1300 rpm, 1100 rpm, 1000 rpm, 900 rpm, and 800 rpm. FIG. 13 shows that, as the number of revolutions decreases, the sound pressure level of a sound of each frequency decreases. All the graphs G11 to G17 of different numbers of revolutions show that there are similar tendencies that the sound pressure level changes with a change in the frequency.

Figure 14:
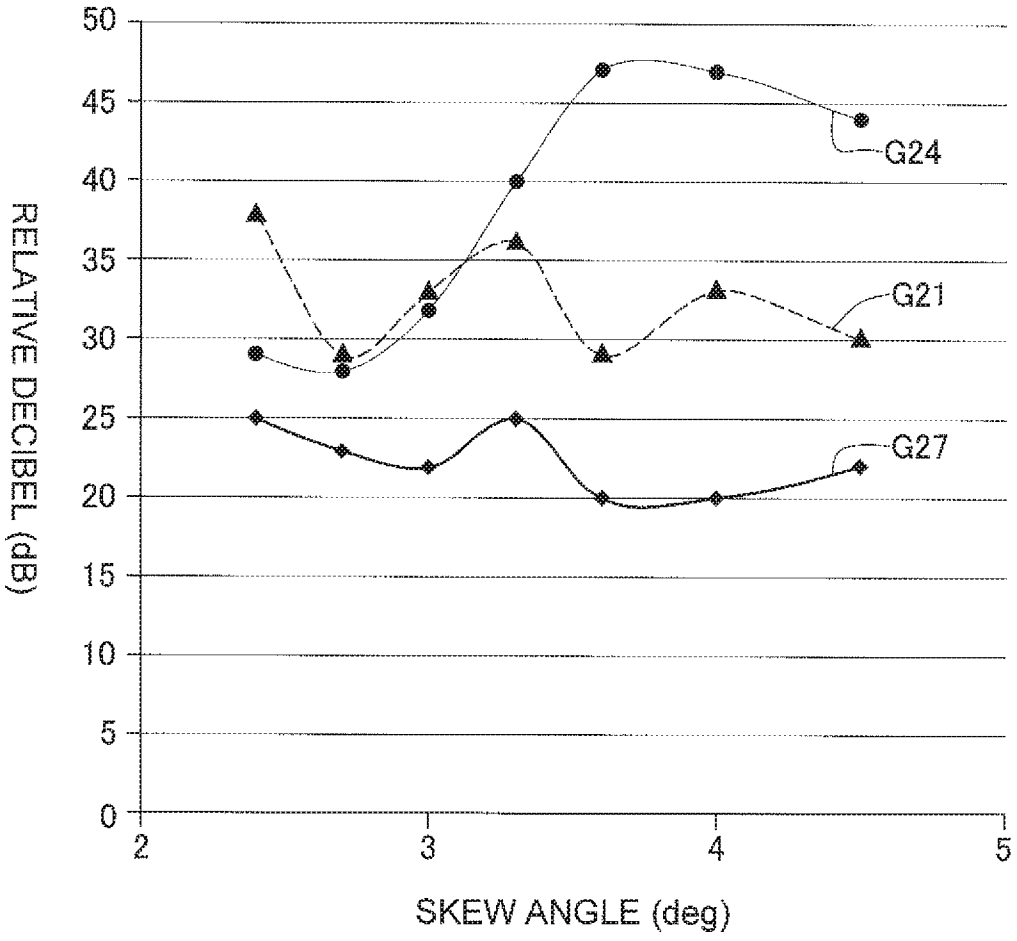
FIG. 14 is a graph showing an example of the relationship between the relative decibel of noises having different frequencies and the skew angle in 11 impellers.
Figure 15:
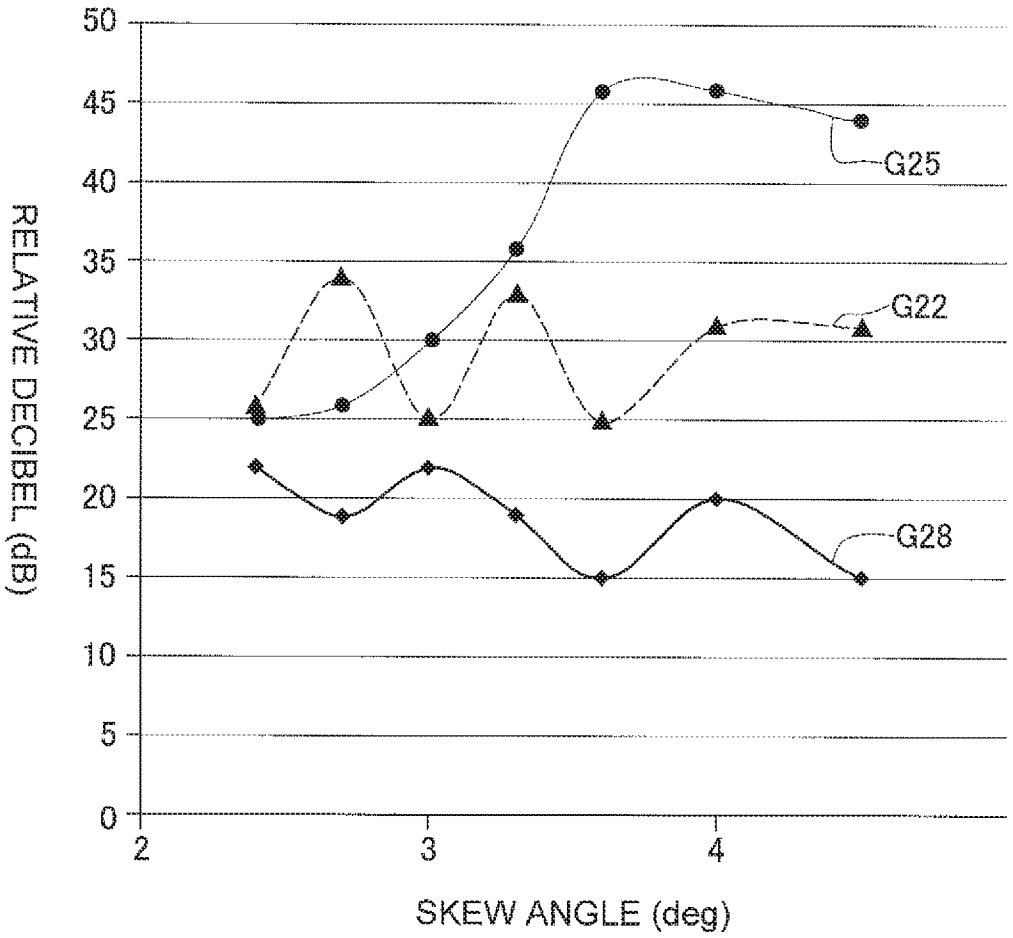
FIG. 15 is a graph showing an example of the relationship between the relative decibel of noises having different frequencies and the skew angle in 17 impellers.
Figure 16:
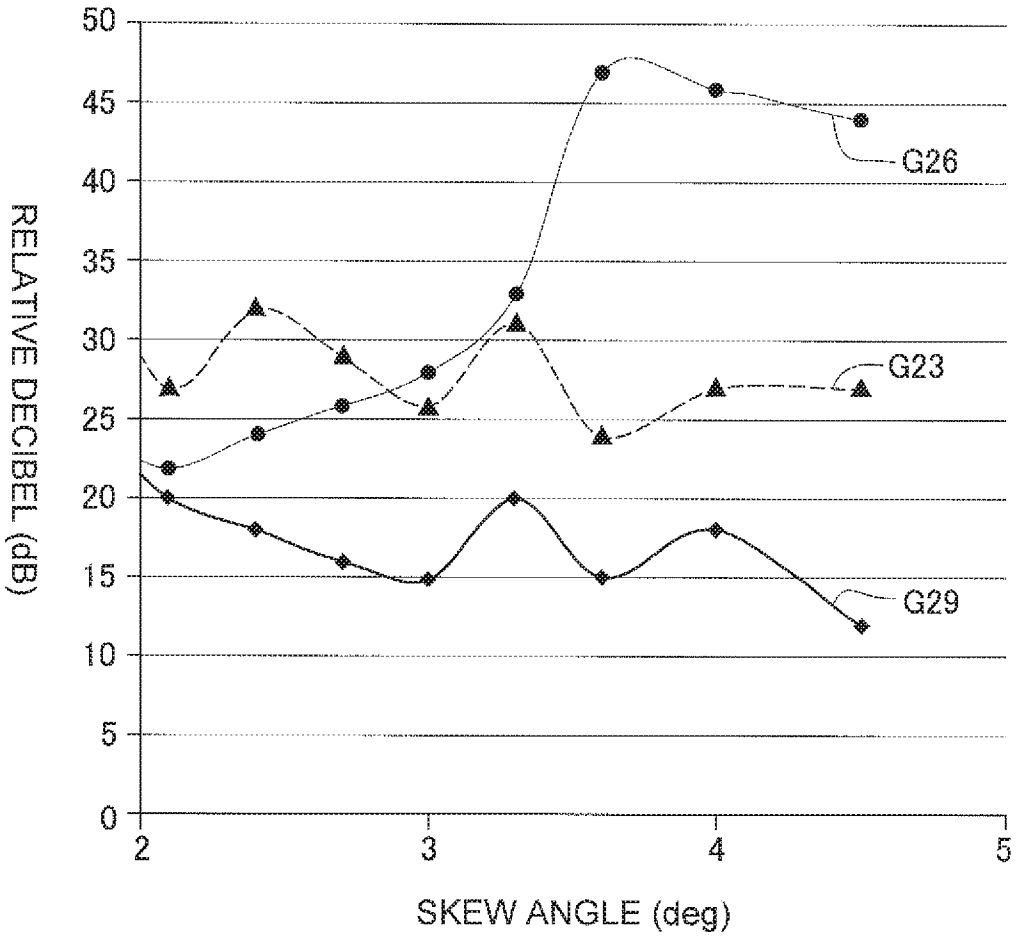
FIG. 16 is a graph showing an example of the relationship between the relative decibel of noises having different frequencies and the skew angle in 20 impellers.
Figure 17:
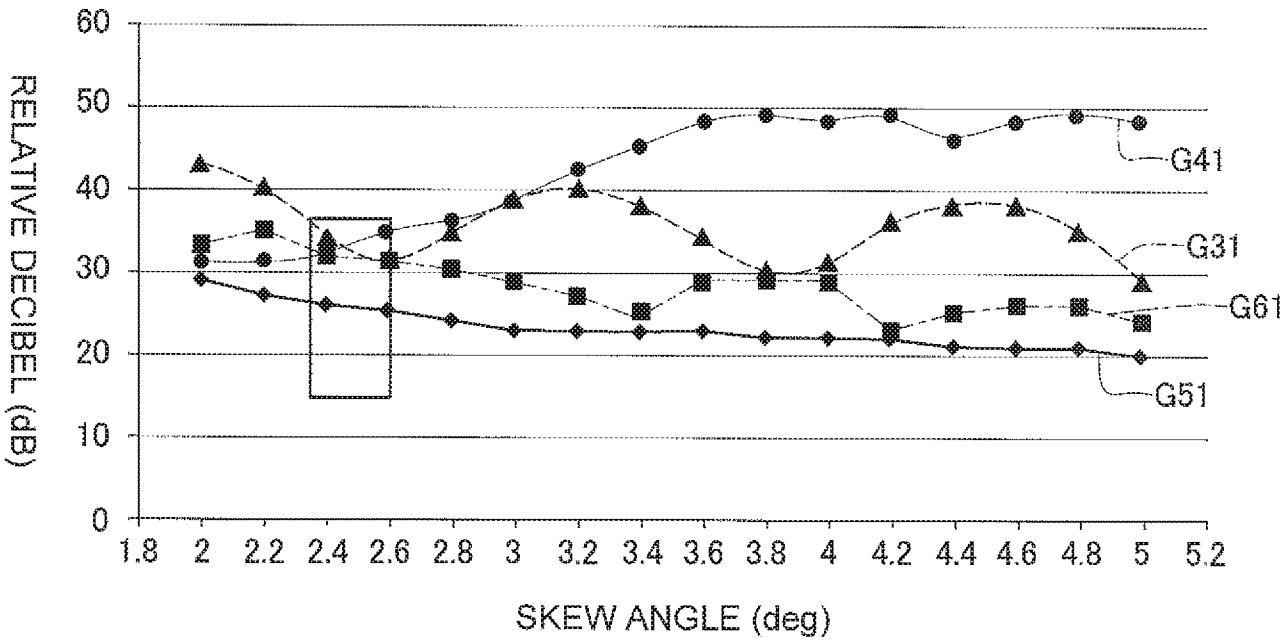
FIG. 17 is a graph showing an example of the relationship between the relative decibel of noises having different frequencies and the skew angle in 8 impellers.
Figure 18:
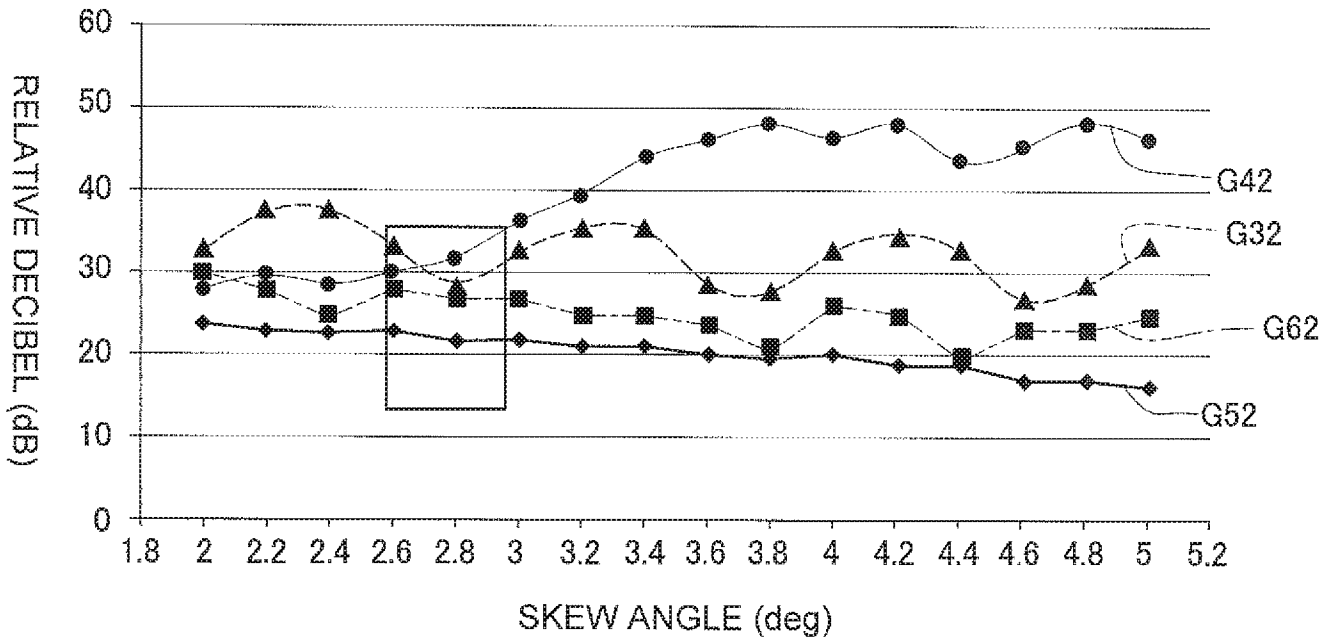
FIG. 18 is a graph showing an example of the relationship between the relative decibel of noises having different frequencies and the skew angle in 11 impellers.
Figure 19:
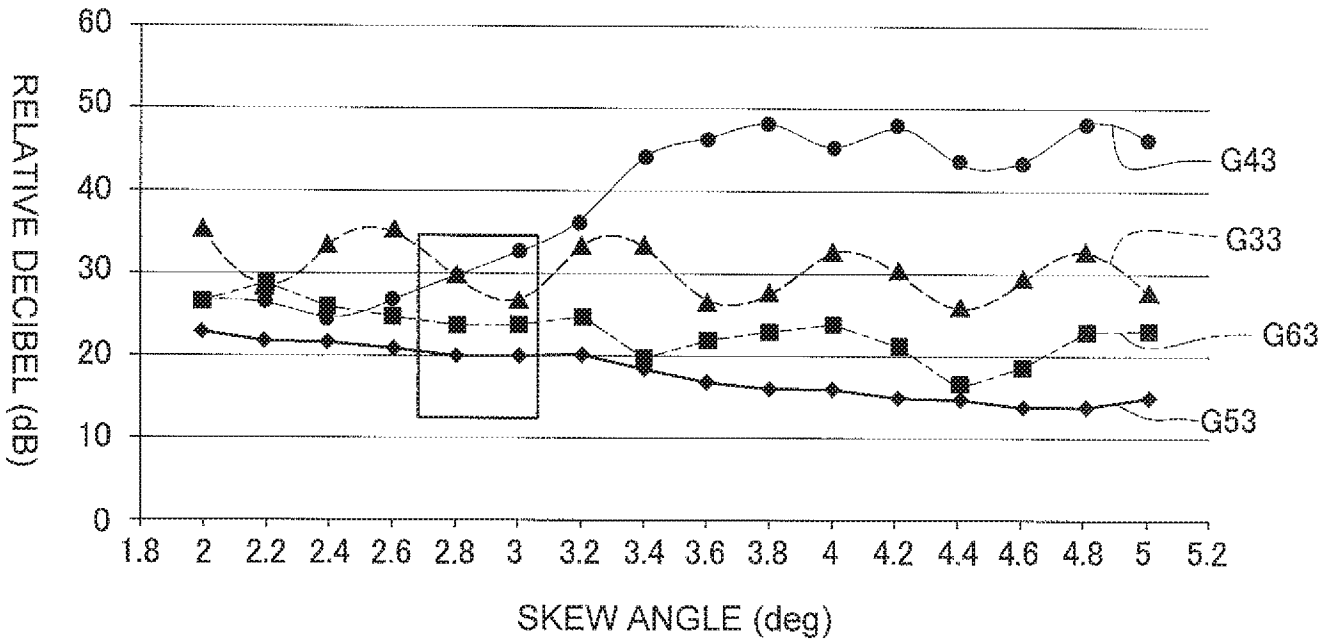
FIG. 19 is a graph showing an example of the relationship between the relative decibel of noises having different frequencies and the skew angle in 14 impellers.
Figure 20:
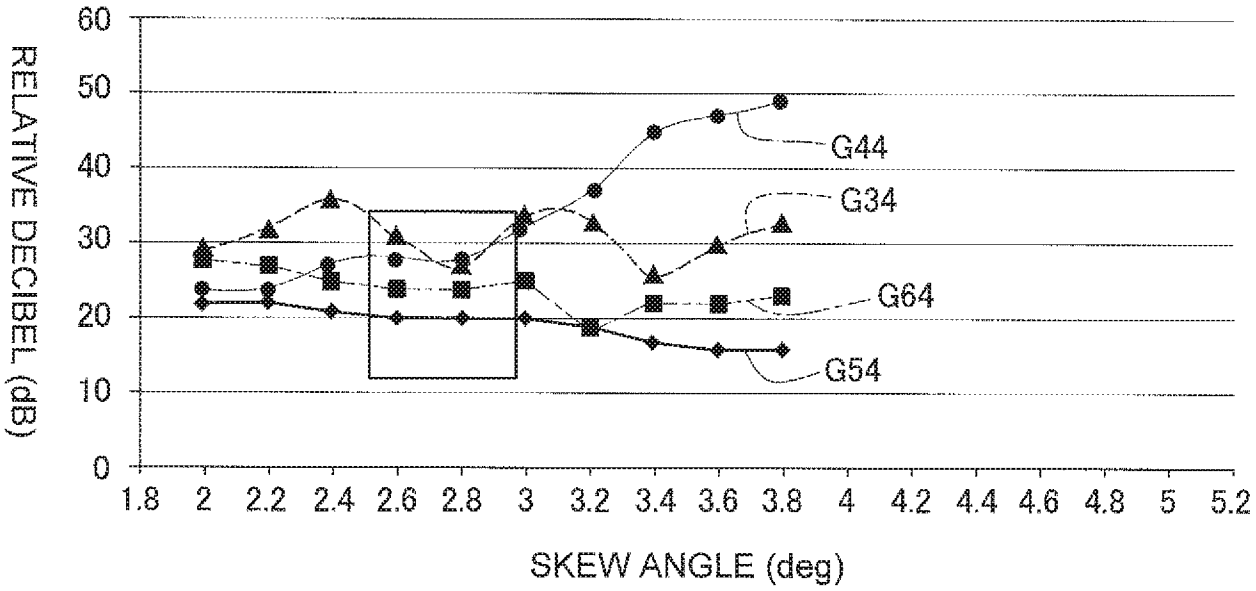
FIG. 20 is a graph showing an example of the relationship between the relative decibel of noises having different frequencies and the skew angle in 15 impellers.
Figure 21:
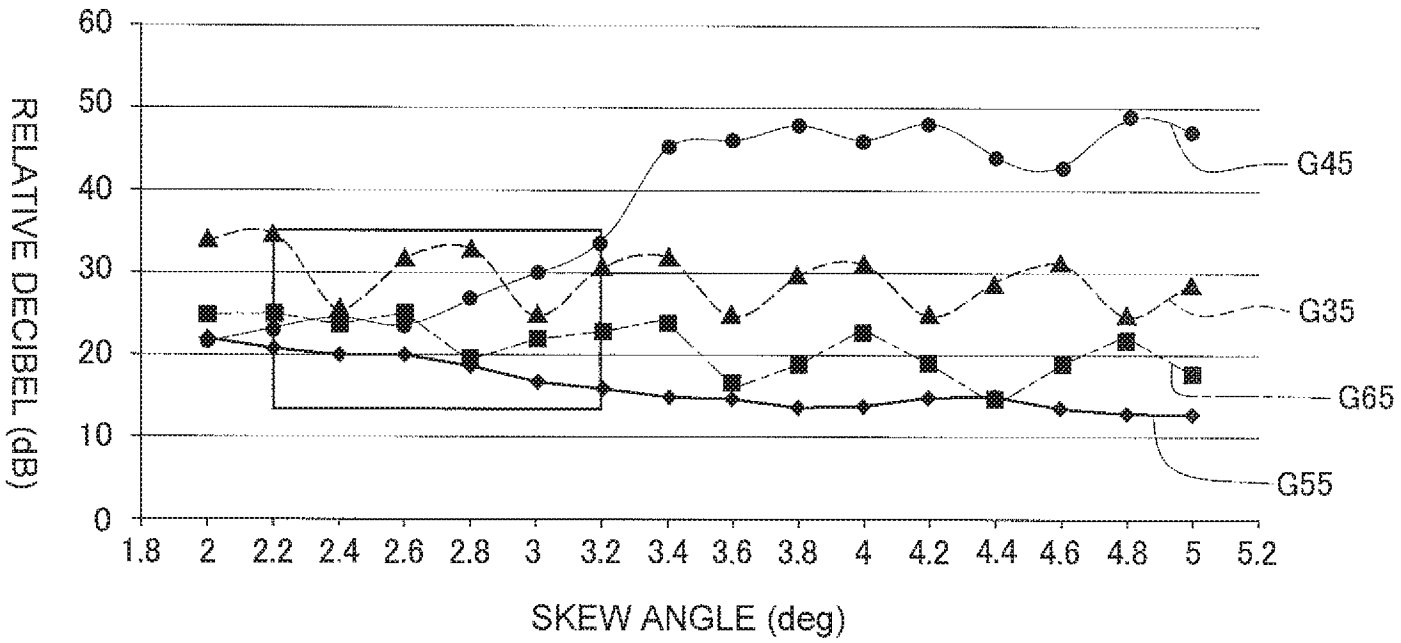
FIG. 21 is a graph showing an example of the relationship between the relative decibel of noises having different frequencies and the skew angle in 17 impellers.
Figure 22:
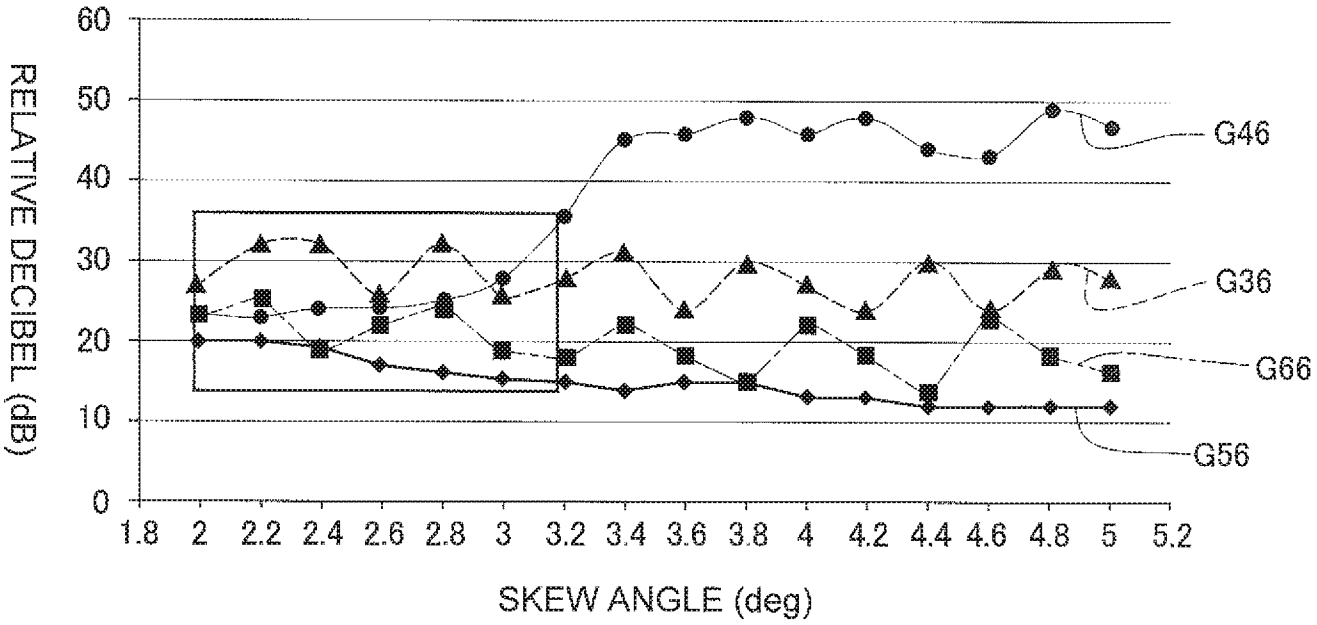
FIG. 22 is a graph showing an example of the relationship between the relative decibel of noises having different frequencies and the skew angle in 20 impellers.
Figure 23:
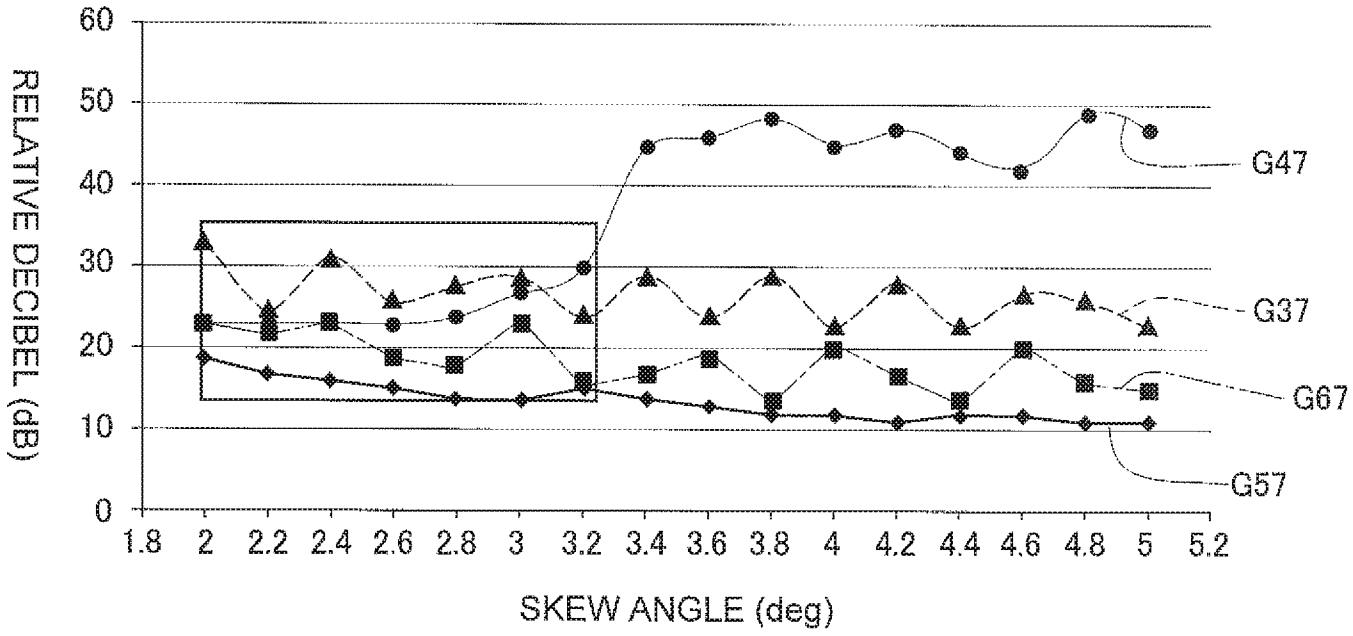
FIG. 23 is a graph showing an example of the relationship between the relative decibel of noises having different frequencies and the skew angle in 23 impellers.

FIGS. 14, 15, and 16 show the relationship between the skew angle and the relative decibel of each frequency. FIGS. 14, 15, and 16 respectively show graphs in cases where the number of impellers 41 is 11, 17, and 20. However, conditions other than the number of impellers 41 are the same in all the graphs. Graphs G21, G22, and G23 show the relative decibel of a noise around 1NZ in the rotation order range of 30th to 40th. Graphs G24, G25, G26 show the relative decibel of a noise of 2NZ to 3NZ in the rotation order range of 75th to 100th. Graphs G27, G28, G29 show the relative decibel of a low-frequency noise in the rotation order range of 5th to 25th. It can be understood from the comparison between the graphs G27 to G29 in FIGS. 14, 15, and 16 that there is a tendency that it becomes difficult to find a point where the relative decibel of the low-frequency noise can be reduced at a smaller skew angle even when the number of impellers 41 is changed. On the other hand, it can be understood from the comparison between the graphs G24 to G26 in FIGS. 14, 15, and 16 that a point of the skew angle where a sound suddenly becomes large when the skew angle is increased is shifted to a side having a larger skew angle as the number of impellers 41 is increased. For example, in the graph G24 in which the number of impellers 41 is 11, the noise of 2NZ to 3NZ suddenly increases when the skew angle exceeds 2.7°. In the graph G25 in which the number of impellers 41 is 17, the noise of 2NZ to 3NZ suddenly increases when the skew angle exceeds a certain angle between 2.7° and 3.0°. In the graph G26 in which the number of impellers 41 is 20, the noise of 2NZ to 3NZ suddenly increases when the skew angle exceeds a certain angle between 3.0° and 3.3°.

(2-2) Appropriate Range of Skew Angle

FIGS. 17, 18, 19, 20, 21, 22, and 23 show graphs in cases where the number of impellers 41 is 8, 11, 14, 15, 17, 20, and 23, respectively. Values of the relative decibel in these graphs are calculated by the method described above with reference to FIG. 10 similarly to FIGS. 14 to 16. The length of each impeller 41 is adjusted so that the total length of a plurality of impellers 41 becomes the same length even when the number of impellers 41 is changed. The same adjustment is also performed in other graphs for comparison for the influence of the number of impellers 41. FIGS. 17 to 23 show results of consideration of a setting range of the skew angle with which a reduction of approximately 25 dB or more of the noise around 1NZ and the noise of 2NZ to 3NZ can be expected by the unequal-pitch impellers and the skew angle.

Graphs G31, G32, G33, G34, G35, G36, and G37 show the relative decibel of a noise around 1NZ having frequencies in the rotation order range of 30th to 40th in the cases where the number of impellers 41 is 8, 11, 14, 15, 17, 20, and 23. Graphs G41, G42, G43, G44, G45, G46, and G47 show the relative decibel of a noise of 2NZ to 3NZ having frequencies in the rotation order range of 70th to 110th in the cases where the number of impellers 41 is 8, 11, 14, 15, 17, 20, and 23. Graphs G51, G52, G53, G54, G55, G56, and G57 show the relative decibel of a low-frequency noise having frequencies in the rotation order range of 1st to 20th in the cases where the number of impellers 41 is 8, 11, 14, 15, 17, 20, and 23. Further, graphs G61, G62, G63, G64, G65, G66, and G67 show the relative decibel of a low-frequency noise having frequencies in the rotation order range of 1st to 30th in the cases where the number of impellers 41 is 8, 11, 14, 15, 17, 20, and 23.

In FIGS. 17 to 23, ranges surrounded by rectangular frames are ranges in which values of the relative decibel in the graphs G31 to G37, the graphs G41 to G47, the graphs G51 to G57, and the graphs G61 to G67 are equal to or lower than 35 dB. When a plurality of impellers 41 are ultrasonic-welded, for example, a variation of approximately ±0.3° may occur. In such a case, a tolerance for the skew angle is preferably set to, for example, 0.6°, and it is shown that the tolerance can be set to 0.6° by using 17, 20, or 23 impellers 41.

Figure 24:
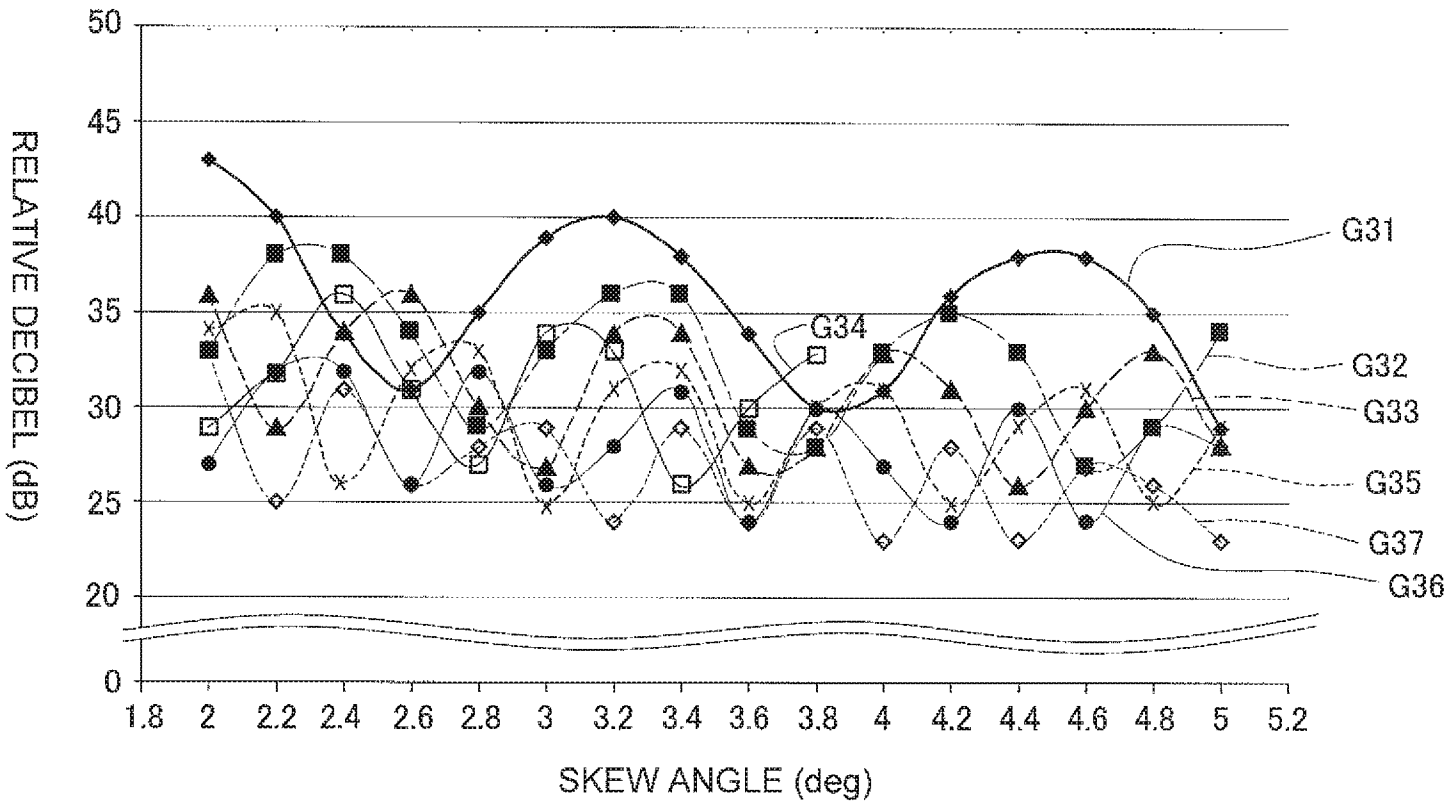
FIG. 24 is a graph showing an example of the relationship between the relative decibel of a noise around 1NZ and the skew angle for different numbers of impellers.
Figure 25:
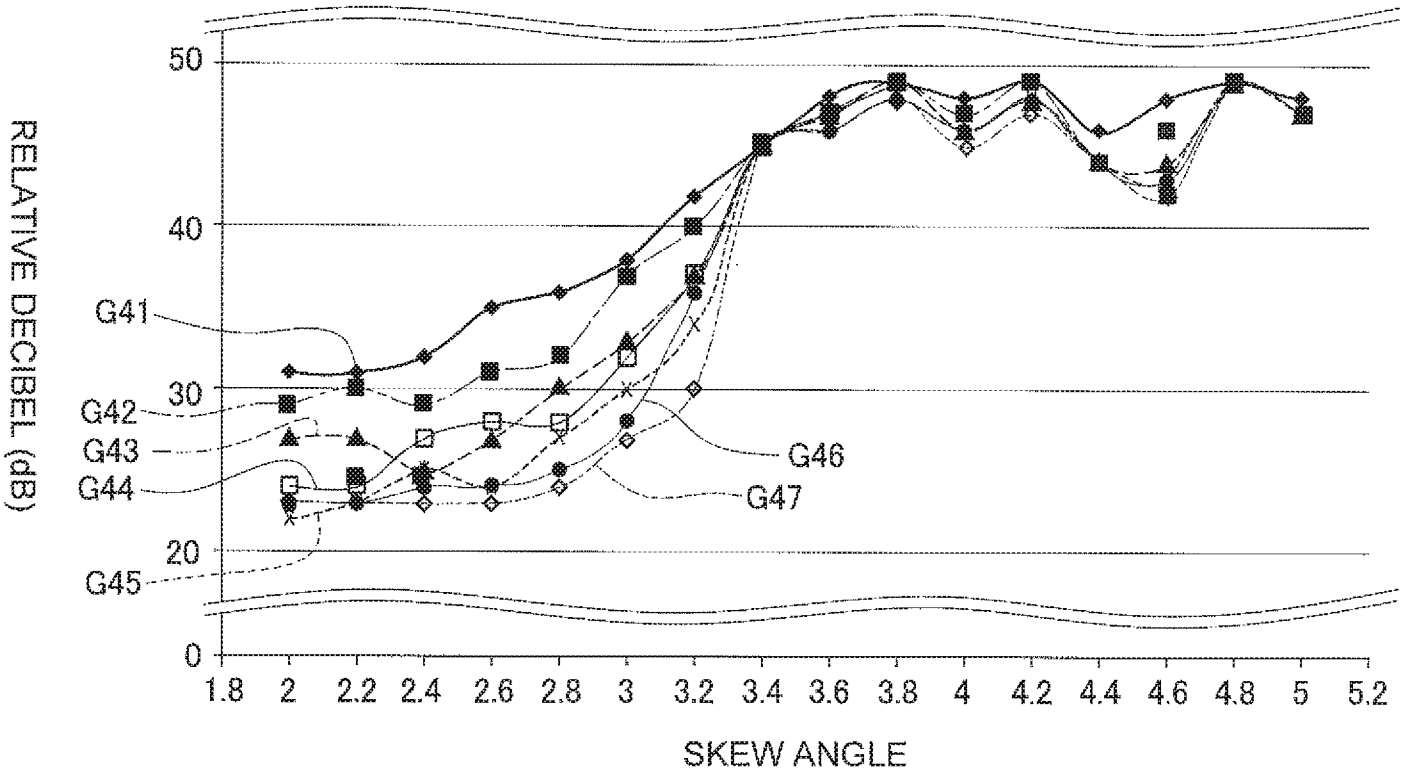
FIG. 25 is a graph showing an example of the relationship between the relative decibel of a noise of 2NZ to 3NZ and the skew angle for different numbers of impellers.
Figure 26:
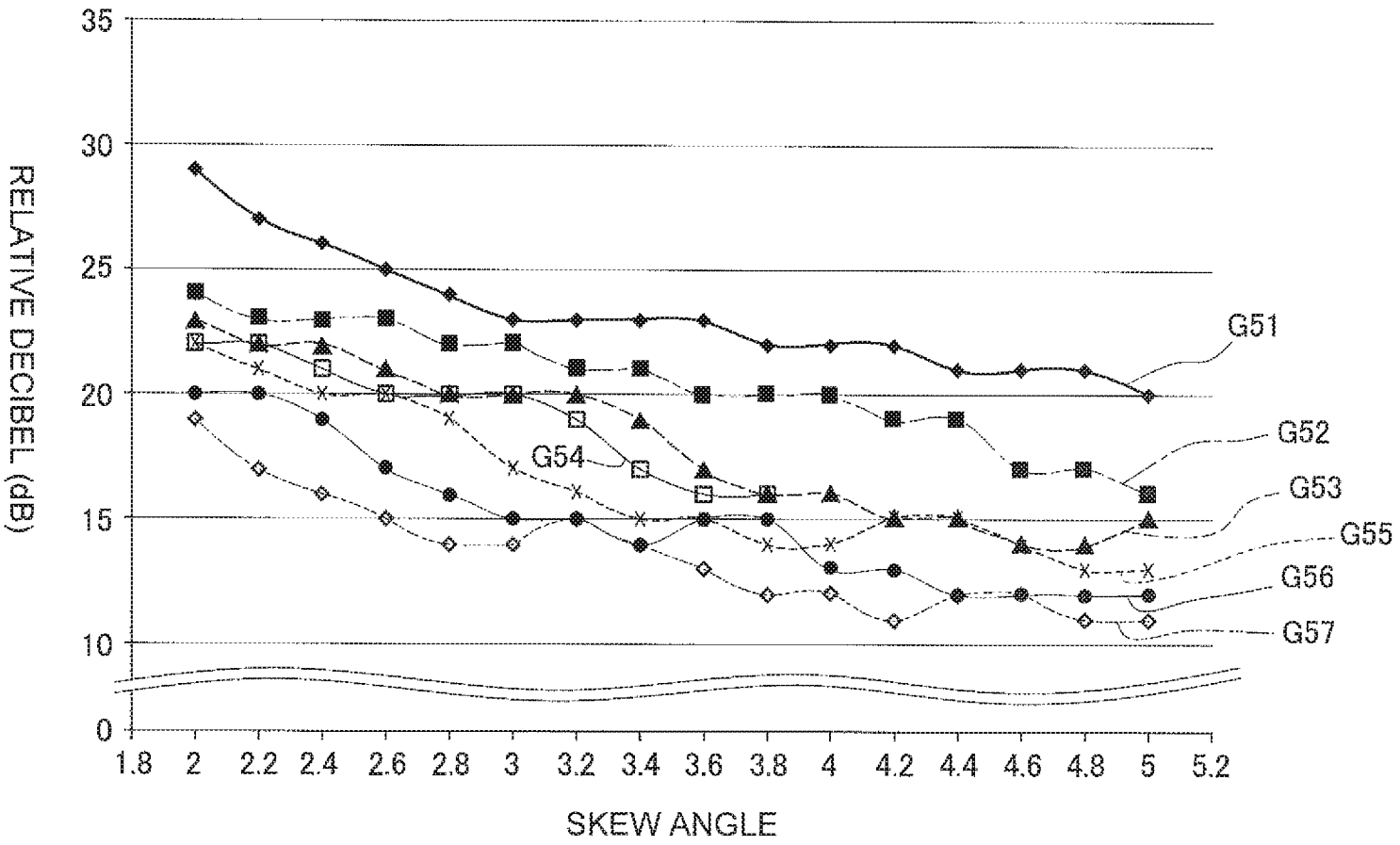
FIG. 26 is a graph showing an example of the relationship between the relative decibel of a low-frequency noise and the skew angle for different numbers of impellers.

FIG. 24 shows the graphs G31 to G37 in FIGS. 17 to 23. FIG. 25 shows the graphs G41 to G47 in FIGS. 17 to 23. FIG. 26 shows the graphs G51 to G57 in FIGS. 17 to 23. In FIG. 24, when a small skew angle becomes larger, all the relative decibels in the graphs G31 to G37 showing the noise around 1NZ fluctuate. However, although a fluctuation period is large and an amplitude is also large when the number of impellers 41 is small, the fluctuation period becomes smaller and the amplitude also becomes smaller as the number of impellers 41 increases. Further, the graphs G31 to G37 tend to entirely (when the mean value of each graph is considered) shift in the direction of reducing the relative decibel as the number of impellers 41 increases. For example, in the graph G31 showing the case where the number of impellers 41 is 8, the period is approximately 1.3° (e.g., vertexes are recognized at skew angles of 3.2° and 4.7°), and the amplitude is approximately 10 dB (e.g., it is recognized that the relative decibel is 40 dB at a skew angle of 3.2° and approximately 30 dB at a skew angle of 3.8° to 3.9°). On the other hand, in the graph G37 showing the case where the number of impellers 41 is 23, the period is approximately 0.4° (e.g., vertexes are recognized at skew angles of 3.4° and 3.8°), and the amplitude is approximately 5 dB (e.g., it is recognized that the relative decibel is approximately 29 dB at a skew angle of 3.2° and approximately 24 dB at a skew angle of 3.6°). In this manner, it becomes easy to reduce the noise around 1NZ by increasing the number of impellers 41.

FIG. 25 shows that the relative decibel of the noise of 2NZ to 3NZ falls within the range of 40 dB to 50 dB and fluctuates around a relatively large value when the skew angle is within the range of 3.4° to 5.0°. On the other hand, when the skew angle is within the range of 2.0° to 3.0°, the relative decibel falls within the range of 20 dB to 40 dB and tends to increase as the skew angle increases. Among the graphs G41 to G47, in the graphs G43 to G47 showing the cases where the number of impellers 41 is 14 to 23, the relative decibel falls within the range of 20 dB to 35 dB when the skew angle is within the range of 2.0° to 3.0°. In particular, among these graphs, in the graphs G45, G46, and G47 showing the cases where the number of impellers 41 is 17, 20, and 23, the relative decibel falls within the range of 20 dB to 30 dB when the skew angle is within the range of 2.0° to 3.0°.

FIG. 26 shows that the relative decibel of the low-frequency noise in the rotation order of 1st to 20th tends to decrease as the skew angle increases regardless of the number of impellers 41. Further, the graphs G51 to G57 tend to entirely (when the mean value of each graph is considered) shift in the direction of reducing the relative decibel as the number of impellers 41 increases.

Figure 27:
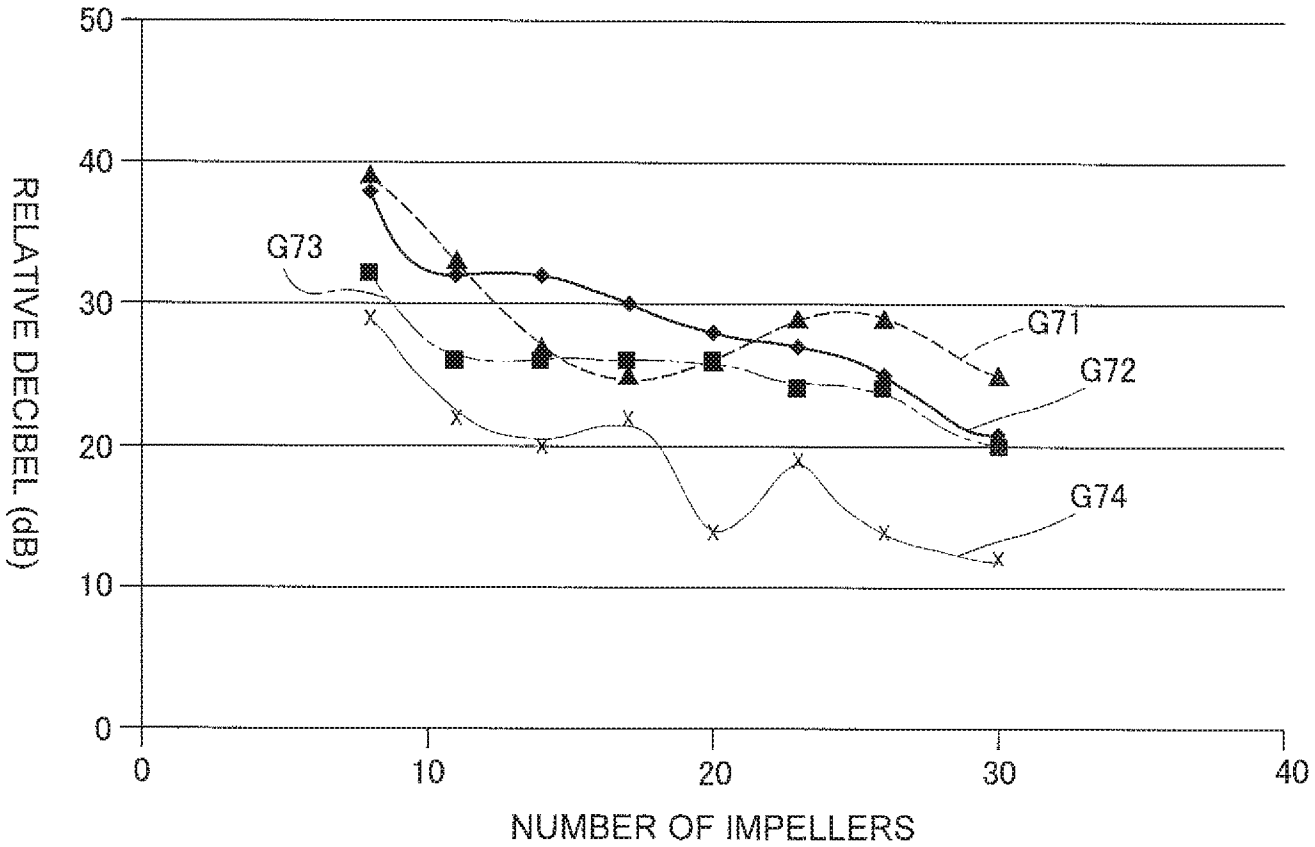
FIG. 27 is a graph showing an example of the relationship between the number of impellers and the relative decibel of noises having different frequencies in a case where the skew angle is 3.0°.

FIG. 27 shows changes in the relative decibel when the number of impellers 41 is changed with the skew angle fixed at 3.0°. In FIG. 27, a graph G71 shows changes in the relative decibel of a noise around 1NZ having frequencies in the rotation order range of 30th to 40th. A graph G72 shows changes in the relative decibel of a noise of 2NZ to 3NZ having frequencies in the rotation order range of 75th to 100th. A graph G73 shows changes in the relative decibel of a noise around 2.5 NZ having frequencies in the rotation order range of 75th to 90th. A graph G74 shows changes in the relative decibel of a low-frequency noise having frequencies in the rotation order range of 5th to 25th. The graphs G71 to G74 of FIG. 27 show that it becomes easy to set a lower relative decibel as the number of impellers 41 increases.

The combination of FIGS. 25 and 26 shows that, for the same number of impellers 41, the skew angle is preferably increased in order to improve the low-frequency noise reduction, but, on the other hand, the skew angle is preferably reduced to 3.2° or less, and more preferably reduced to 3.0° or less in order to improve the noise of 2NZ to 3NZ reduction. This corresponds to the ranges indicated by the rectangular frames described above with reference to FIGS. 17 to 23. For example, the skew angle is preferably within the range of 2.7° to 3.1° when the number of impellers 41 is 14, the skew angle is preferably within the range of 2.5° to 3.0° when the number of impellers 41 is 15, the skew angle is preferably within the range of 2.2° to 3.2° when the number of impellers 41 is 17, the skew angle is preferably within the range of 2.0° to 3.2° when the number of impellers 41 is 20, and the skew angle is preferably within the range of 2.0° to 3.2° when the number of impellers 41 is 23. That is, the above graphs show that the skew angle is preferably within the range of 2.7° to 3.0° when the number of impellers 41 is 14 or more, and the skew angle is preferably within the range of 2.2° to 3.2° when the number of impellers 41 is 17 or more.

Figure 28:
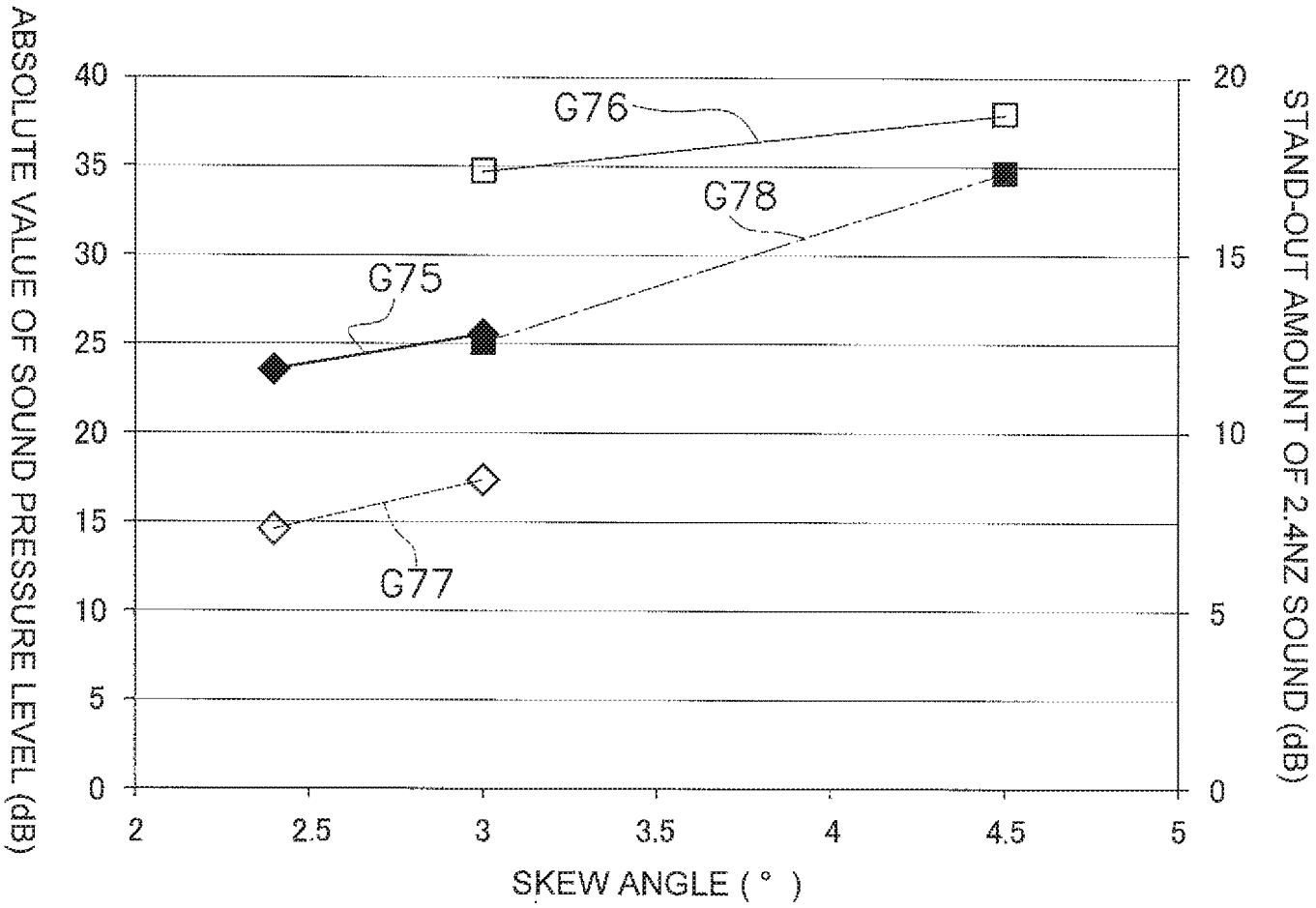
FIG. 28 is a graph showing an example of the relationship between the skew angle and an absolute value of the sound pressure level of noise and the relationship between the skew angle and a stand-out amount of a 2.4NZ sound.

FIG. 28 shows the relationship between the skew angle and an absolute value of the sound pressure level of noise and the relationship between the skew angle and a stand-out amount of a 2.4NZ sound in a case where the number of revolutions of the impellers 41 is 1100 rpm. In the above mode in which a plurality of impellers 41 are coupled together, the stand-out amount of the 2.4NZ sound is a sound pressure level standing out as an unusual sound from sounds having frequencies around the 2.4NZ sound. In FIG. 28, a graph G75 shows changes in the sound pressure level of noise in a case where 20 impellers 41 are coupled together, and a graph G76 shows changes in the sound pressure level of noise in the case where 11 impellers 41 are coupled together. Further, a graph G77 shows the stand-out amount of the 2.4NZ sound in the case where 20 impellers 41 are coupled together, and a graph G78 shows the stand-out amount of the 2.4NZ sound in the case where 11 impellers 41 are coupled together. FIG. 28 shows that the 2.4NZ sound can be reduced by reducing the skew angle in the skew angle range of 2.4° to 3.0° in the case where the 20 impellers 41 are included and in the skew angle range of 3.0° to 4.5° in the case where the 11 impellers 41 are included. The sound pressure level of the noise is a result of an actual measurement of the noise produced in the air conditioner 10 including the impellers 41 attached inside thereof. The noise can also be reduced by reducing the skew angle in the skew angle range of 2.4° to 3.0° in the case where the 20 impellers 41 are included and in the skew angle range of 3.0° to 4.5° in the case where the 11 impellers 41 are included.

(2-3) Influence of the Number of Impellers 41

Figure 29:
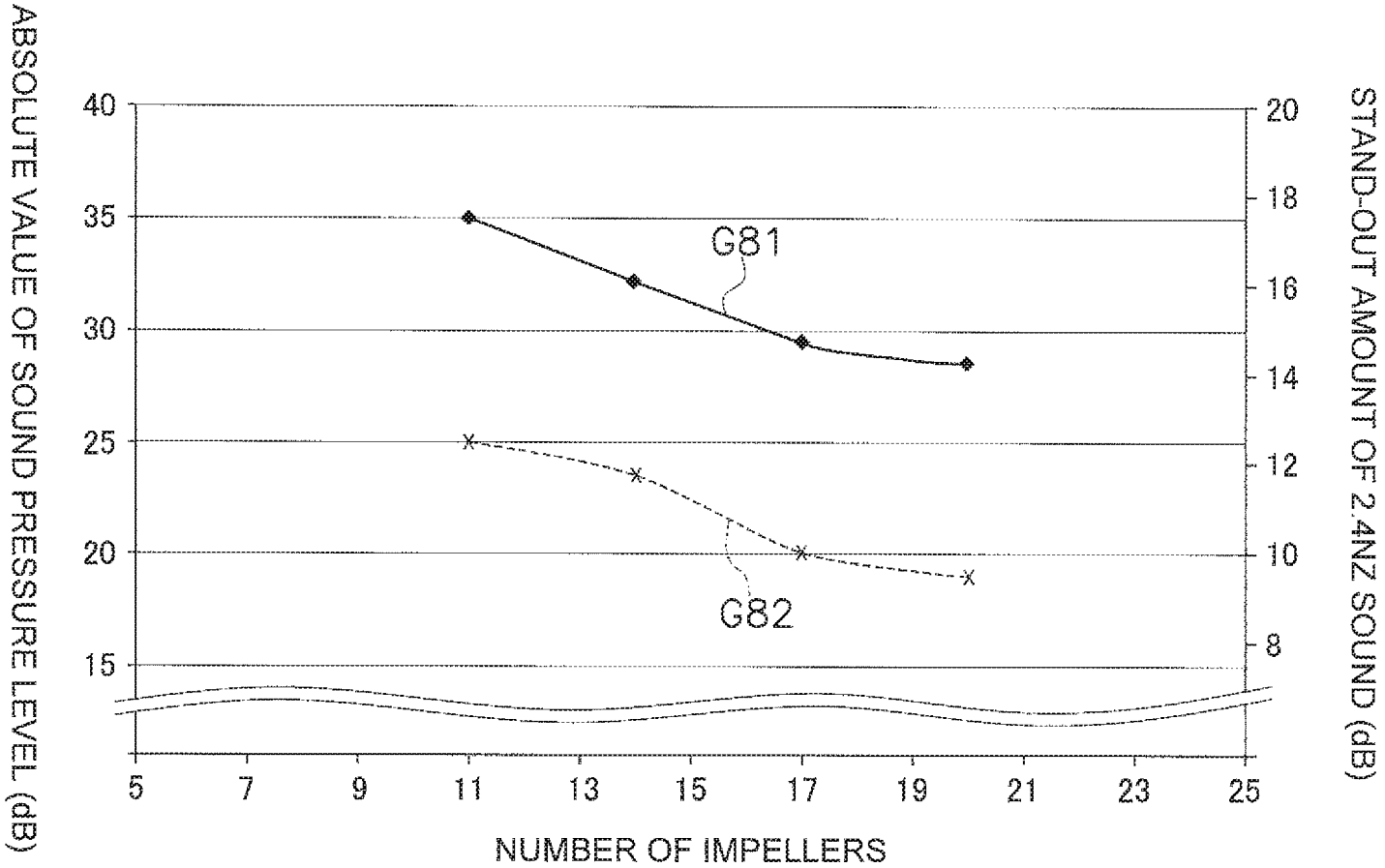
FIG. 29 is a graph showing an example of the relationship between the number of impellers and the absolute value of the sound pressure level of noise and the relationship between the skew angle and the stand-out amount of the 2.4NZ sound.

Changes in the relative decibel when the number of impellers 41 is changed have already been described above with reference to FIG. 27. Here, there will be further described an example of the relationship between the number of impellers 41 and the absolute value of the sound pressure level of noise and an example of the relationship between the number of impellers 41 and the stand-out amount of the 2.4NZ sound in a case where the number of revolutions is 1100 rpm with reference to FIG. 29. In FIG. 29, a graph G81 shows changes in the absolute value of the sound pressure level of noise, and a graph G82 shows changes in the stand-out amount of the 2.4NZ sound. Both the graphs G81, G82 show a tendency that both the sound pressure level and the stand-out amount decrease as the number of impellers 41 increases. However, there is a tendency that these decreases are reduced when the number of impellers 41 is 17 or more.

Figure 30:
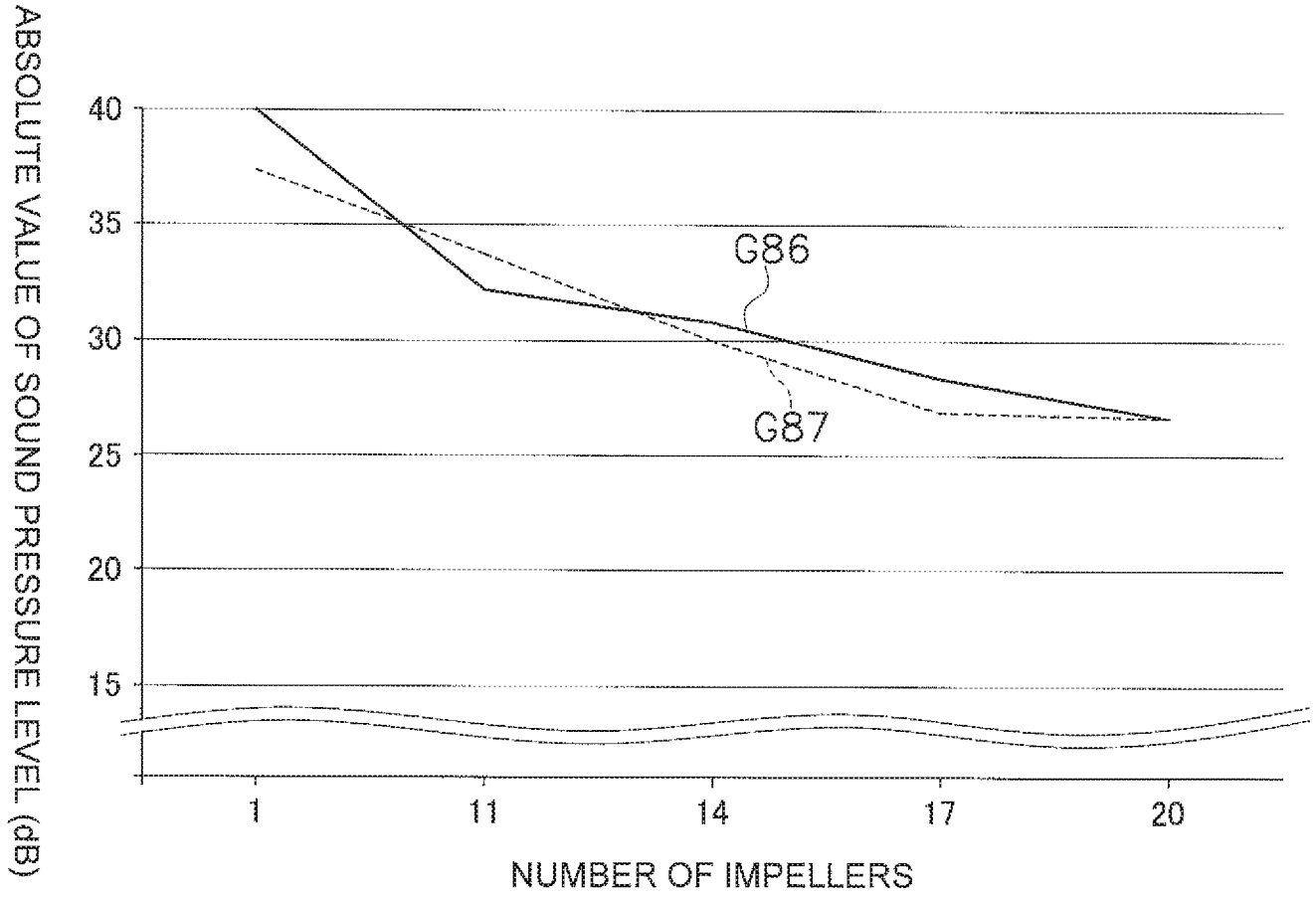
FIG. 30 is a graph showing an example of the relationship between the number of impellers and the absolute value of the sound pressure level for a 1NZ sound and a 2NZ sound.

FIG. 30 shows an example of the relationship between the absolute value of the sound pressure level of the NZ sound and the number of impellers. A graph G86 is a graph relating to the 1NZ sound, and a graph G87 is a graph relating to the 2NZ sound. The sound pressure level decreases as the number of impellers 41 increases in both the 1NZ sound and the 2NZ sound. In particular, there is a tendency that the decrease in the sound pressure level of the 2NZ sound is reduced when the number of impellers 41 is 17 or more.

(2-4) Influence of the Number of Impellers 41

Figure 31:
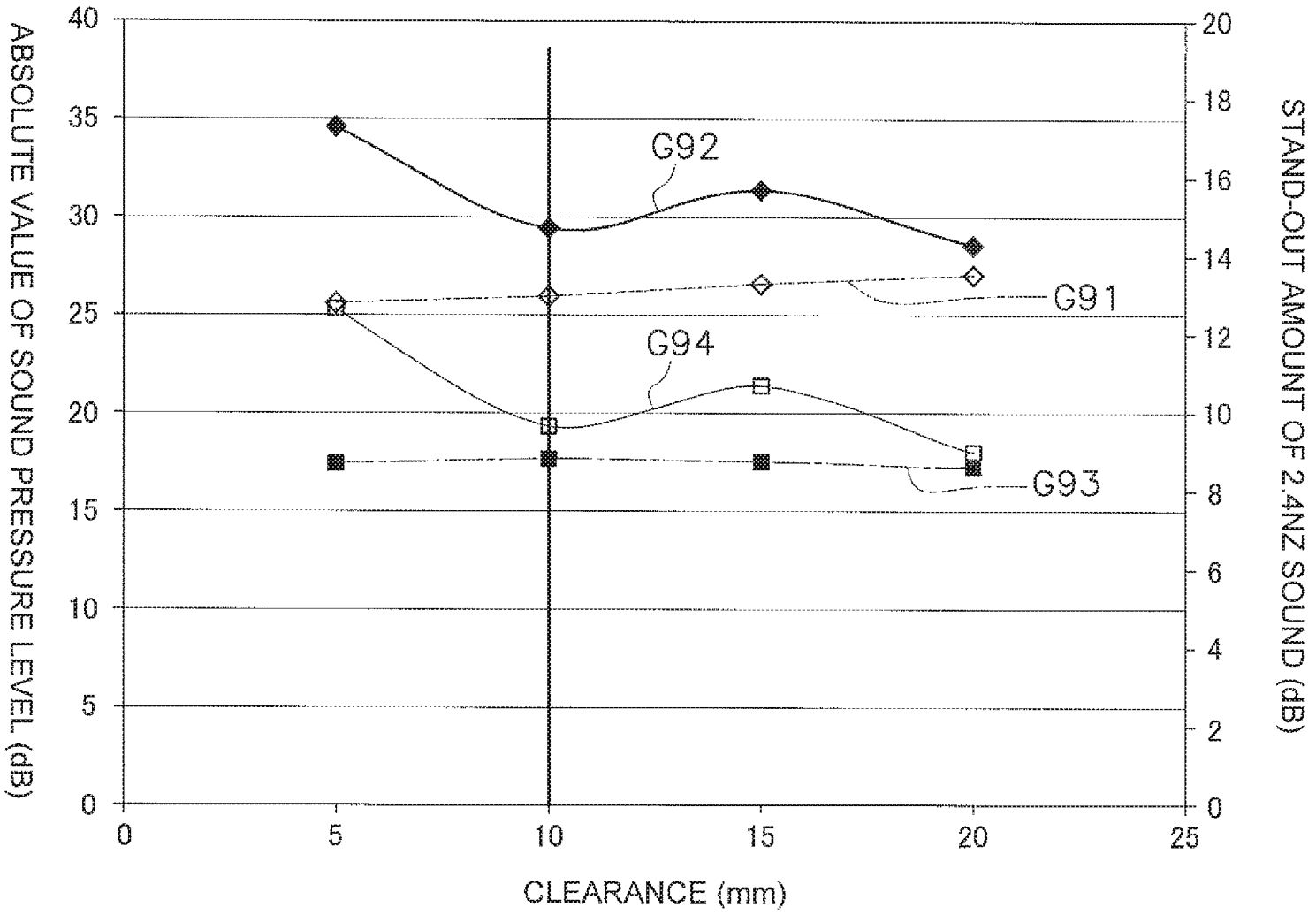
FIG. 31 is a graph showing an example of the relationship between the size of a clearance and the absolute value of the sound pressure level of noise and the relationship between the skew angle and the stand-out amount of the 2.4NZ sound.

FIG. 31 shows an example of the relationship between the clearance In and the absolute value of the sound pressure level of noise and the relationship between the clearance In and the stand-out amount of the 2.4NZ sound in a case where the skew angle is 3.0°, and the number of revolutions is 1100 rpm. The clearance In is the distance from the impeller 41 to the heat transfer fin 36, and changes in the range of 5 mm to 20 mm in FIG. 31. Data shown in FIG. 31 is for the case where the diameter D1 of the impeller 41 is 105 mm. Thus, FIG. 31 shows data of the clearance In in the range of approximately 5% to approximately 19% of the diameter D1.

In FIG. 31, a graph G91 shows changes in the sound pressure level of noise in the case where 20 impellers 41 are coupled together, and a graph G92 shows changes in the sound pressure level of noise in the case where 11 impellers 41 are coupled together. Further, a graph G93 shows changes in the stand-out amount of the 2.4NZ sound in the case where 20 impellers 41 are coupled together, and a graph G94 shows changes in the stand-out amount of the 2.4NZ sound in the case where 11 impellers 41 are coupled together. The graphs G92 and G94 show that, in the 11 impellers 41, both the sound pressure level of noise and the stand-out amount of the 2.4NZ sound tend to increase as the clearance In becomes smaller. Further, both the sound pressure level of noise and the stand-out amount of the 2.4 NZ sound tend to largely fluctuate according to the size of the clearance In. On the other hand, the graphs G91 and G93 show that, in the 20 impellers 41, both the sound pressure level of noise and the stand-out amount of the 2.4NZ sound do not change much even when the clearance In becomes smaller, and the ranges of fluctuations in the sound pressure level of noise and the stand-out amount of the 2.4NZ sound according to the size of the clearance In are also small.

(2-5) Influence of Cutouts 42*a* of Blade 42

Figure 32:
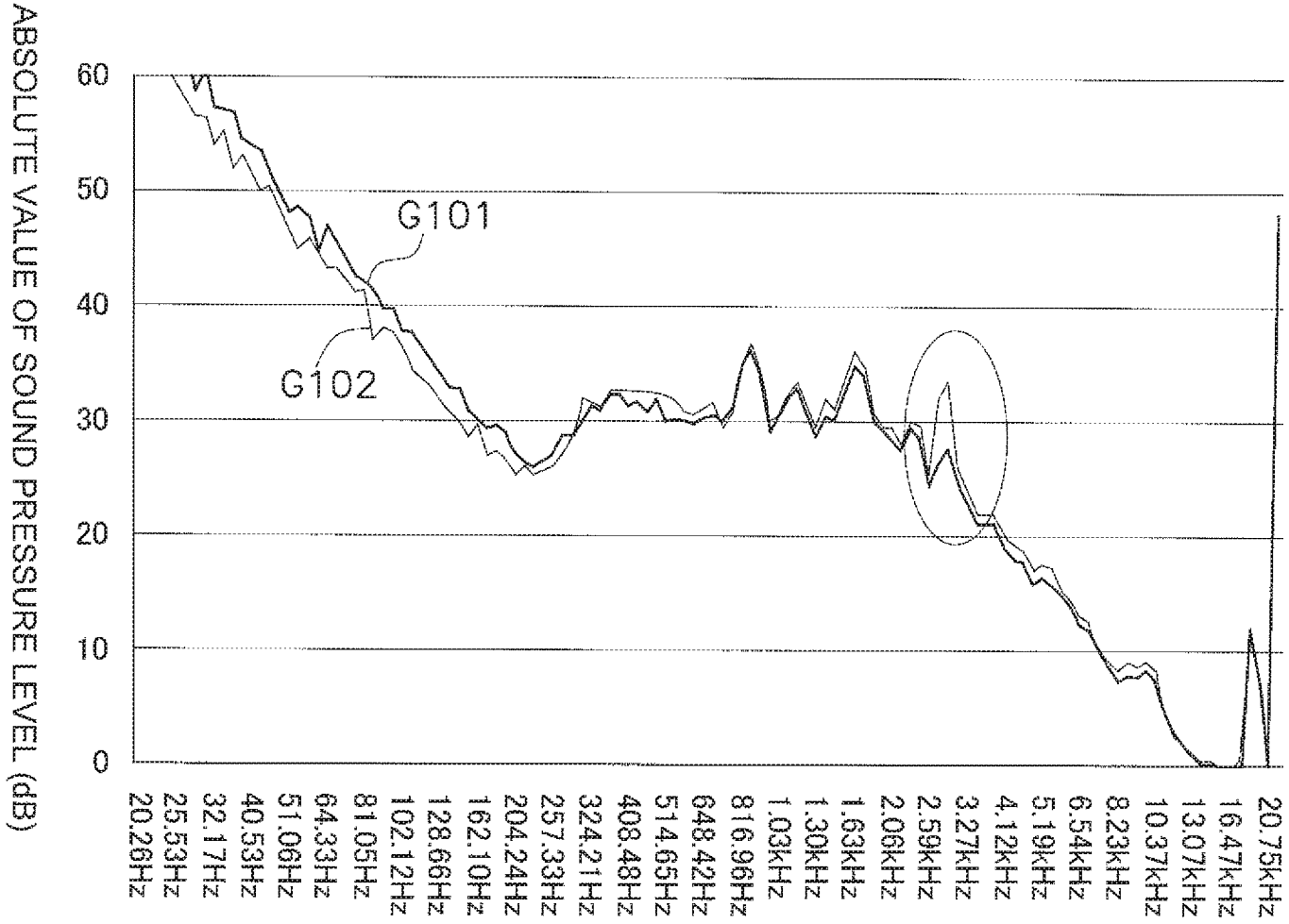
FIG. 32 is a graph showing an example of the relationship between a frequency included in noise and the absolute value of the sound pressure level in a case with cutouts and a case with no cutout.

FIG. 32 shows an example of the relationship between a frequency included in noise and the absolute value of the sound pressure level in a case where 20 impellers 41 are included, the clearance In is 5 mm, the skew angle is 3.0°, and the number of revolutions is 1400 rpm. In FIG. 32, a graph G101 shows a result of an actual measurement using the impellers 41 each of which has the cutouts 42*a*, and a graph G102 shows a result of an actual measurement using the impellers 41 each of which does not have the cutouts 42*a*. The graph G101 and the graph 102 largely differ from each other in the stand-out amount of the 2.4NZ sound, which is a part surrounded by an ellipse in FIG. 32. The stand-out amount of the 2.4NZ sound can be reduced by approximately 3 dB by using the impellers 41 each of which has the cutouts 42*a* compared to the case where the impellers 41 each of which does not have the cutouts 42*a* are used.

(2-6) NZ Sound Reducing Effect

Figure 33:
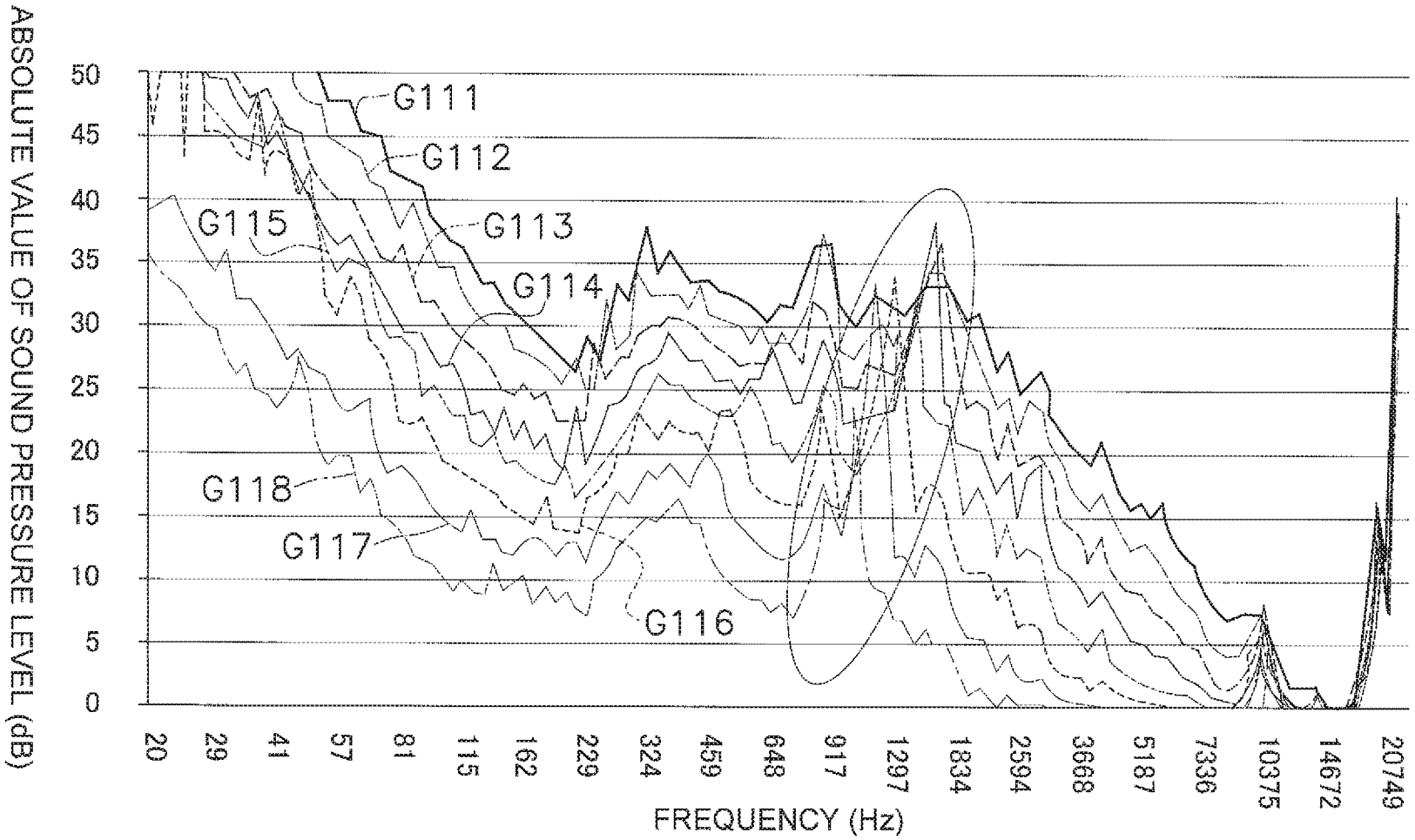
FIG. 33 is a graph showing an example of an actual measured value of noise for 10 unequal-pitch impellers having no cutout.
Figure 34:
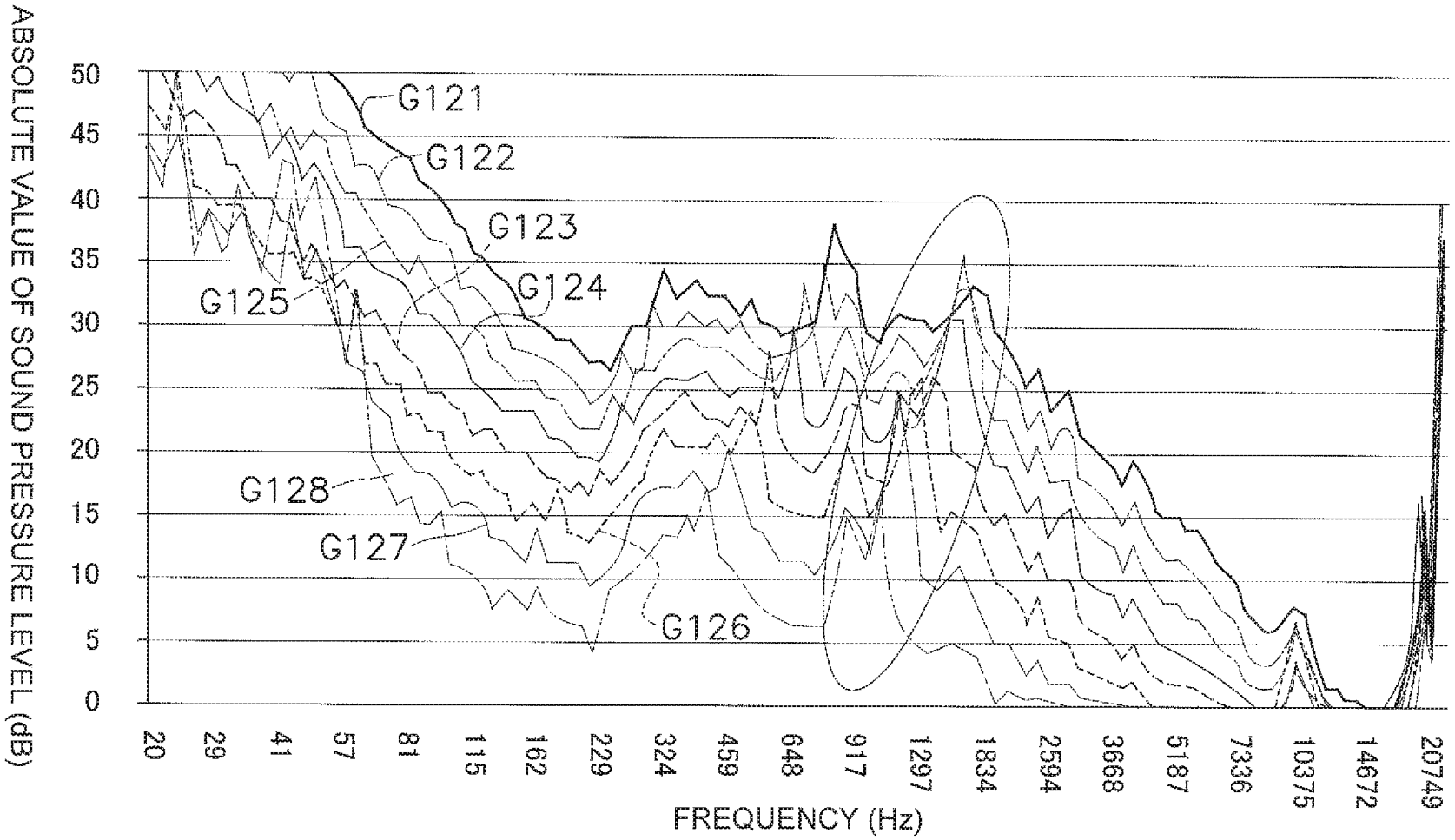
FIG. 34 is a graph showing an example of an actual measured value of noise for 10 unequal-pitch impellers having cutouts.
Figure 35:
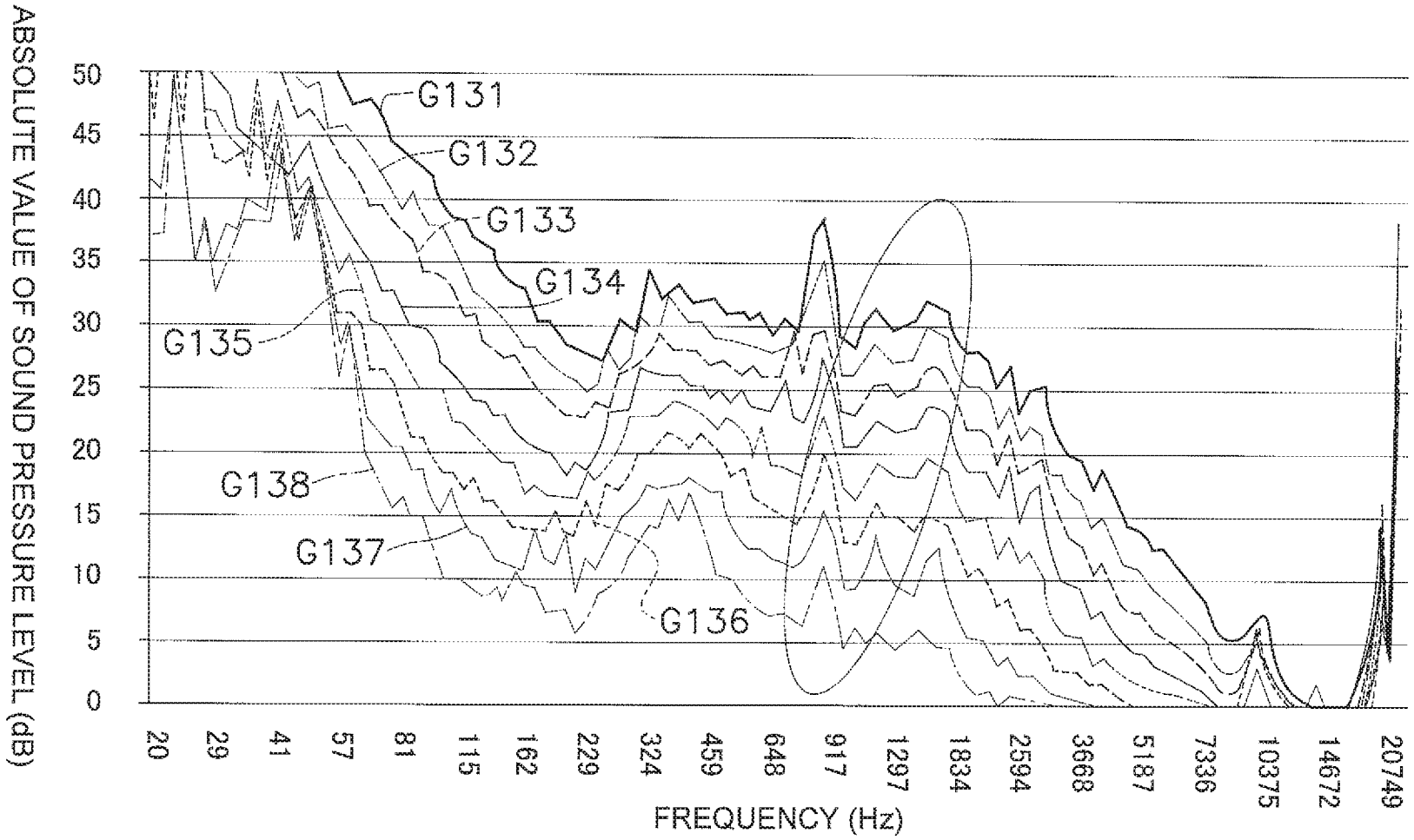
FIG. 35 is a graph showing an example of an actual measured value of noise for 20 unequal-pitch impellers having no cutout.

FIG. 33 shows an analysis result of an actual measured value of noise for ten unequal-pitch impellers 41 each of which does not have the cutouts 42*a*, the impellers 41 being coupled together with a skew angle of 4.5°. FIG. 34 shows an analysis result of an actual measured value of noise for ten unequal-pitch impellers 41 each of which has the cutouts 42*a*, the impellers 41 being coupled together with an appropriately adjusted skew angle. FIG. 35 shows an analysis result of an actual measured value of noise for 20 unequal-pitch impellers 41 each of which does not have the cutouts 42*a*, the impellers 41 being coupled together with an appropriately adjusted skew angle. In FIGS. 33, 34, and 35, graphs Gill to G118, graphs G121 to G128, and graphs G131 to G138 show analysis results in cases where the number of revolutions is 1400 rpm, 1300 rpm, 1200 rpm, 1100 rpm, 1000 rpm, 900 rpm, 800 rpm, and 700 rpm, respectively. It can be understood from the comparison between parts surrounded by ellipses in FIGS. 33, 34, and 35 that a sound having a frequency relating to NZ is reduced by the cutouts 42*a* and by doubling the number of impellers 41.

(3) Modifications (3-1) Modification 1A

In the above embodiment, between adjacent impellers 41, all the 35 blades 42 of one impeller 41 are displaced from the respective 35 blades 42 of the other impeller 41 by setting the skew angle. An arrangement of the unequal pitch may not be the same between the adjacent impellers 41. For example, unequal-pitch impellers 41 having different pitches may be used, and the blades 42 may be arranged at the same positions between the adjacent impellers 41. In this manner, it is not necessary that all the corresponding blades 42 be displaced between the adjacent impellers 41, and it is only required that at least one blade 42 be displaced between the adjacent impellers 41.

(3-2) Modification 1B

In the above embodiment, for example, all the 20 impellers 41 are coupled together and integrated as a single coupled body. However, when the impellers 41 are integrated together, the impellers 41 may not be a single coupled body. For example, each ten of the impellers 41 may be coupled and integrated together to constitute two coupled bodies. In this case, these two coupled bodies are configured to rotate in conjunction with each other.

(3-3) Modification 1C

In the above embodiment, the air conditioner 10 is a wall-mount air conditioner which is mounted on the wall WA. However, the air conditioner 10 is not limited to the wall-mount air conditioner. For example, the air conditioner 10 may be an air conditioner suspended from the ceiling.

(4) Characteristics (4-1)

As described above, the impellers 41 are arranged with at least one of the blades 42 displaced between adjacent impellers 41. The above embodiment mainly describes the case where the number of impellers 41 is 20. However, when the number of impellers 41 arranged along the rotation axis is 14 or more and 30 or less in the cross-flow fan 40, the noises of 2NZ to 3NZ sounds produced in the respective impellers 41 can be sufficiently cancelled with each other. As a result, the noise of 2NZ to 3NZ sounds in the cross-flow fan 40 can be sufficiently reduced. As described above, when the sound pressure level in the specific range between 2 NZ and 3NZ (e.g., the above sounds having frequencies from 70th to 110th (the noise of 2NZ 20 to 3NZ) has decreased, it may be determined that the noise of 2NZ to 3NZ sounds have been reduced. Alternatively, focusing on a sound having a specific frequency to be reduced among the 2NZ to 3NZ sounds (e.g., the 2.4NZ sound or the 2.5NZ sound described above), when the sound pressure level of the sound having the focused frequency among the 2NZ to 3NZ sounds has decreased, it may be determined that the noise of 2NZ to 3NZ sounds have been reduced. When the reduction in the noise of 2NZ to 3NZ sounds is determined based on the decrease in the sound pressure level in the specific range between 2NZ and 3NZ, the setting of the range may be appropriately performed according to situations, and is not limited to the above example. Further, when focusing on the sound having the specific frequency, the frequency of a sound to be focused on may be appropriately determined according to situations, and is not limited to the above example.

(4-2)

When the number of impellers 41 is 17 or more, as described above with reference to FIG. 25, a variation range in the noise including 2NZ to 3NZ sounds due to fluctuations caused by the tolerance of the phase shift (skew angle) is reduced. Further, since the number of impellers 41 is 25 or less, it is possible to prevent an air blowing resistance by the partition plates 43 from becoming too large. As a result, it is possible to stably supply the air conditioner 10 having an excellent air blowing performance and high quietness.

(4-3)

When the length dimension of each of the impellers 41 in the rotation axis direction is equal to or less than 40% of the diameter D1, the length of the cross-flow fan 40 can also be reduced, and the length of the air conditioner 10 in the rotation axis direction (the length in the right-left direction) can be reduced. Such a structure makes the air conditioner 10 compact.

(4-4)

The heat exchanger 30 is disposed with the clearance In equal to or less than 10% of the diameter D1 of the impeller 41. Such a structure enables a space occupied by the heat exchanger 30 and the cross-flow fan 40 to be reduced. Thus, the depth dp of the air conditioner 10 in the front-back direction can be reduced, which enables the air conditioner 10 to be made compact.

(4-5)

The above embodiment describes the case where the diameter D1 of the impeller 41 is 105 mm. However, the cross-flow fan 40 can obtain a sufficient air blowing performance when the diameter D1 of the impeller 41 is 90 mm or more and 150 mm or less, and the number of revolutions is 700 rpm or more and 2000 rpm or less.

What is claimed is:

1. An air conditioner comprising: a cross-flow fan having a cylindrical shape, the cross-flow fan including a plurality of impellers, each of the impellers including a plurality of blades arranged in a circumferential direction; and a heat exchanger disposed on an upstream side of an air flow of the cross-flow fan with a clearance being formed between the cross-flow fan and the heat exchanger, the clearance having a dimension no more than 20% of a diameter of each of the impellers, the impellers being arranged with at least one of the blades displaced between each adjacent two of the impellers, and a number of the impellers arranged along a rotation axis being at least 17 and no more than 25 in the cross-flow fan, each of the plurality of impellers being connected together to form a single unit, the cross-flow fan having a number of revolutions that is no more than 2000 rpm.

2. The air conditioner according to claim 1, wherein a length dimension of each of the impellers in a rotation axis direction is no more than 40% of the diameter of each of the impellers in the cross-flow thin.

3. The air conditioner according to claim 1, wherein the heat exchanger is disposed with the clearance no more than 10% of the diameter of each of the impellers.

4. The air conditioner according to claim 1, wherein the diameter of each of the impellers is at least 90 mm and no more than 150 mm, and the cross flow fan has a number of revolutions that is at least 700 rpm and no more than 2000 rpm.

5. The air conditioner according to claim 1, wherein a length dimension of each of the impellers in a rotation axis direction is no more than 40% of the diameter of each of the impellers in the cross-flow fan.

6. The air conditioner according to claim 1, wherein the heat exchanger is disposed with the clearance no more than 10% of the diameter of each of the impellers.

7. The air conditioner according to claim 1, wherein the diameter of each of the impellers is at least 90 mm and no more than 150 mm, and the cross flow fan has a number of revolutions that is at least 700 rpm and no more than 2000 rpm.

8. The air conditioner according to claim 2, wherein the heat exchanger is disposed with the clearance no more than 10% of the diameter of each of the impellers.

9. The air conditioner according to claim 2, wherein the diameter of each of the impellers is at least 90 mm and no more than 150 mm, and the cross flow fan has a number of revolutions that is at least 700 rpm and no more than 2000 rpm.

10. The air conditioner according to claim 3, wherein the diameter of each of the impellers is at least 90 mm and no more than 150 mm, and the cross flow fan has a number of revolutions that is at least 700 rpm and no more than 2000 rpm.

11. The air conditioner according to claim 1, wherein each of the plurality of impellers is disposed on a shaft, the shaft passing through each of the plurality of impellers.

12. The air conditioner according to claim 1, wherein the single unit formed by the plurality of impellers has a first end and a second end.

13. The air conditioner according to claim 1, wherein the plurality of impellers includes a first impeller, a last impeller, and a plurality of intervening impellers disposed between the first impeller and the last impeller, each of the plurality of intervening impellers being directly connected to two of the plurality of impellers.

* * * * *